US006430348B1

(12) United States Patent
Asano et al.

(10) Patent No.: US 6,430,348 B1
(45) Date of Patent: Aug. 6, 2002

(54) FIBER HAVING OPTICAL INTERFERENCE FUNCTION AND USE THEREOF

(75) Inventors: Makoto Asano; Toshimasa Kuroda, both of Ibaraki; Shinji Owaki, Ichinomiya; Kinya Kumazawa; Hiroshi Tabata, both of Yokohama; Susumu Shimizu, Hiratsuka; Akio Sakihara, Isehara, all of (JP)

(73) Assignees: Teijin Limited, Osaka; Nissan Motor Co., Ltd., Kanagawa; Tanaka Kikinzoku Kogyo K.K., Tokyo, all of (JP)

( * ) Notice: Subject to any disclaimer, the term of this patent is extended or adjusted under 35 U.S.C. 154(b) by 0 days.

(21) Appl. No.: 09/202,279

(22) PCT Filed: Apr. 10, 1998

(86) PCT No.: PCT/JP98/01667

§ 371 (c)(1),
(2), (4) Date: Dec. 11, 1998

(87) PCT Pub. No.: WO98/32904

PCT Pub. Date: Jul. 30, 1998

(30) Foreign Application Priority Data

| | | |
|---|---|---|
| Apr. 11, 1997 | (JP) | 9-093382 |
| Apr. 11, 1997 | (JP) | 9-093393 |
| Apr. 11, 1997 | (JP) | 9-093403 |
| Apr. 11, 1997 | (JP) | 9-093469 |
| Oct. 17, 1997 | (JP) | 9-284869 |

(51) Int. Cl.[7] ..... G02B 6/10

(52) U.S. Cl. ..... 385/131

(58) Field of Search ..... 385/131, 124, 385/14, 143, 132, 144, 129, 37, 145; 428/220, 373, 480, 328

(56) References Cited

FOREIGN PATENT DOCUMENTS

| | | |
|---|---|---|
| JP | A-7-34320 | 2/1995 |
| JP | A-7-34324 A | 2/1995 |
| JP | A-7-195603 | 8/1995 |
| JP | A-7-331532 | 12/1995 |

*Primary Examiner*—Frank G. Font
*Assistant Examiner*—Tu T Nguyen
(74) *Attorney, Agent, or Firm*—Sughrue Mion, PLLC

(57) ABSTRACT

A flat optical-interference-functional fiber formed by alternately laminating individually independent layers of polymers having different refractive indices in parallel with the major axis direction of its flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, and a fibrous structure using the fiber. According to the present invention, there are provided a fiber which has high color development intensity based on optical interference and forms clear color; and a fibrous structure thereof.

17 Claims, 5 Drawing Sheets

(a)

(b)

FIBER HAVING OPTICAL INTERFERENCE FUNCTION AND USE THEREOF

TECHNICAL FIELD

The present invention relates to a flat fiber having the optical-interference function which is formed by alternately laminating individually independent layers of polymers having different refractive indices in parallel with the major axis of its flat cross section, and a use thereof.

BACKGROUND ART

An fiber having the optical-interference function which is formed of alternate laminates of individually independent layers of polymers having different refractive indices interferes with a color having a wavelength of visible light range and develops a color by the reflection interference actions of natural light. This color development has a brightness like a metallic gloss, gives a pure and clear color (monochromatic) having a specific wavelength and has an artificial gracefulness entirely different from a color formed by the light absorption of a dye or a pigment. Typical examples thereof are disclosed in JP-A-7-34324, JP-A-7-34320, JP-A-7-195603 and JP-A-7-331532.

The optical interference effect is greatly influenced by a refractive index difference between two kinds of polymer layers, an optical distance (refractive index x thickness of each layer) of each layer and the number of laminate-forming layers. Above all, a fiber having an excellent optical interference effect is a fiber which is formed by laminating individually independent layers of polymers having different refractive indices in parallel with the major axis direction of its flat cross section and has a flat structure.

In the above flat fiber formed by alternately laminating two kinds of polymers in parallel with the major axis direction of its flat cross section, however, even if layers of polymers having different refractive indices are used only to extrude the polymer layers alternately laminated from a spinneret having a rectangular form, the actual cross-sectional form is deformed to be elliptical or circular. Consequently, the interface of the alternately laminated layers becomes devoid of parallelism and results in the formation of curved laminate interfaces. Moreover, even if alternately laminated polymer layers are extruded through a spinneret having a rectangular form, it is difficult to form a laminate having a uniform optical distance (i.e., having uniform layer thickness), and as a result, there can be obtained only a fiber having sparse color development wavelengths and a low color development intensity and having a cheap texture. Prior art techniques which have been so far proposed neither recognize the above problems nor teach any solution means.

It is an object of the present invention to provide a fiber having the optical-interference function in which the thickness non-uniformity of each laminate and the curvature of laminate interfaces are reduced as much as possible so that color development wavelengths are converged to show a high color development intensity.

DISCLOSURE OF THE INVENTION

It has been revealed that the above problem is easily solved when the ratio of solubility parameter values (SP) of individually independent layers of polymers having different refractive indices is in a specific range.

According to the present invention, therefore, there is provided a flat fiber having the optical-interference function which is formed by alternately laminating individually independent layers of polymers having different refractive indices in parallel with the major axis direction of its flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$.

The fiber having the optical-interference function, provided by the present invention, and the use thereof will be explained further in detail hereinafter.

In the present specification, the term "fiber" generically includes a mono- or single-filament, a multi-filamentary yarn, a spun yarn and a short-cut or chopped fiber.

The fiber having the optical-interference function of the present invention has a characteristic structure in a cross section taken by cutting it at right angles with the lengthwise direction of the fiber. That is, the overall form of the cross section thereof is of a flat form, and the fiber has a structure in which a number of individually independent layers of polymers having refractive indices are laminated in parallel with the major axis direction-of the above flat form.

In the above cross-sectional form, "individually independent layers of polymers" means that layers of polymers having different refractive indices form a boundary plane in a plane where they are in contact with each other. As described above, the cross-sectional form of the fiber of the present invention shows a flat form in which a number of different polymer layers are alternately laminated. In an preferred embodiment, the fiber has a structure in which a protective layer portion is formed on a circumferential portion of the flat cross section. The protective layer may be formed of a polymer of any of the above laminated polymer layers. Further, the thickness of the protective layer portion is preferably greater than the thickness of the polymer layers of the above laminate portion. The cross-sectional form having the protective layer portion on a circumferential portion will be explained in detail later.

The right-angled cross-sectional structure of the fiber of the present invention will be explained with reference to FIGS. 1 and 2. FIGS. 1 and 2 schematically show cross-sectional forms obtained when the fiber of the present invention is cut at right angles with the lengthwise direction thereof.

FIG. 1 shows a flat cross section having an alternate laminate portion formed of polymer layers A and polymer layers B, and FIG. 2 shows a flat cross section having a protective layer C formed of polymer layer A on the circumferential portion thereof. In each of the cross-sectional forms shown in FIGS. 1 and 2, a number of polymer layers A and polymer layers B are alternately laminated in parallel with the major axis direction of the flat cross section (horizontal direction in Figures).

As shown in FIGS. 1 and 2, the fiber having the optical-interference function of the present invention has a flat cross section, and polymer layers A and polymer layers B are alternately laminated in parallel with the major axis direction of the flat cross section, whereby an area effective for optical interference is widely formed. And, the parallelism of alternate lamination is particularly important for the optical interference function.

In the above fiber, the thickness of each laminate is generally as ultra-thin as 0.3 $\mu$m or less, and it is therefore very difficult to form a regular alternate laminate portion in view of production process. Meanwhile, when the optical distance of each layer of the alternate laminate portion is entirely uniform both in the major axis direction and the minor axis direction of the flat cross section, the wavelength which is reflected and interfered with the fiber to form a color shows an actually uniform and single-wavelength clear color and has a high color development intensity (relative reflectance).

When a molten polymer is spun and drawn to be formed into a fiber, however, an actual reflection spectrum emitted from the fiber has a width to some extent, and it is very difficult to obtain a fiber having an actually uniform and single wavelength, for the following reason.

That is, in the process of spinning two kinds of molten polymers from a spinneret with these polymers being alternately laminating, and then cooling to solidification and drawing the polymers to form a fiber, laminate members gradually lose uniformity. That is because the flow rates of the molten polymers distributed for the layers change due to inevitable variability in the orifice diameter accuracy, etc., of opening portions for distributing the molten polymers for forming alternately laminated layers, and as a result, there is formed a distribution of thickness of each layer. Further, when alternately laminated molten polymers pass a narrow opening or a flow path, a velocity distribution is caused in the narrow opening or flow path due to a shear stress, and the closer to the wall of the opening or flow path, the lower the flow rate of molten polymers. Toward the outer layers of the alternately laminated fiber, therefore, the thickness of the layers decreases.

Further, each molten polymer layer extruded from the rectangle-shaped spinneret tends to round itself due to its surface energy and tends to swell due to a Barus effect, so that the thickness of each layer of the alternately laminated fiber formed in parallel with the flat cross section tends to decrease toward each end.

The requirement to overcome the above disadvantage is to set a ratio of solubility parameter values (SP values) between polymer layers, and more preferably, to provide a protective layer.

First, the ratio (SP ratio) between the solubility parameter value ($SP_1$) of high refractive index polymer (A) to the solubility parameter value ($SP_2$) of low refractive index polymer (B) is maintained in the range of $0.8 \leqq SP_1/SP_2 \leqq 1.2$. When a spinning spinneret to be described later is used and when alternately laminated flows of two kinds of polymers are finally extruded through a rectangle-shaped spinneret, generally, the polymer flows are inclined to round themselves due to a surface tension with ambient air, and a shrinking force works in an interfacial direction so as to minimize the contact area of the interface of two laminated polymers. Since the two polymers form multi-layers, a large shrinking force works, and each surface of laminated layers tends to round itself with being curved. Further, the polymer flows tend to swell due to a Barus effect after released from the spinneret. When two polymers are spun with maintaining the SP ratio of the two polymers in the range of $0.8 \leqq SP_1/SP_2 \leqq 1.2$ against the above behavior of the polymer flows immediately after the spinneret, a fiber can be spun while preventing the laminate from behaving to round themselves due to an interfacial tension. Further, when the SP ratio is set at $0.8 \leqq SP_1/SP_2 \leqq 1.1$, a fiber can be spun more preferably.

In the cross section of the fiber of the present invention, the thickness of each layer of the alternate laminate portion formed of different polymer layers is preferably 0.02 $\mu$m or more and not more than 0.3 $\mu$m. When the thickness is smaller than 0.02 $\mu$m, the expected interference effect can be no longer obtained. On the other hand, when the thickness exceeds 0.3 $\mu$m, the expected interference effect cannot be obtained any longer, either. Further, the thickness is preferably 0.05 $\mu$m or more and not more than 0.15 $\mu$m. Further, when the optical distances, i.e., products of layer thickness and refractive indices, of the two components are equal, a further interference effect can be obtained. Particularly, when a double of the sum of two optical distances equivalent to primary reflection equals the distance of wavelength of desired color, maximum interference color is formed.

In the cross section of the fiber of the present invention, a region where different polymer layers (A and B) are alternately laminated as shown in FIG. 2 will be referred to as an "alternate laminate portion", and its circumferential portion will be referred to as a "protective layer portion".

As described already, when the protective layer portion is formed on a circumferential portion of the alternate laminate portion, the degree of development of single color can be more increased, and further, there can be obtained a fiber excellent in color development intensity (relative reflectance). That is, when the polymer flow distribution caused in the vicinity of a wall surface of, and in the interior of, a final spinneret is alleviated with the protective layer portion, to decrease the shear stress on the laminated portion to be as small as possible, there can be obtained an alternate laminate of which the layers are more uniform in thickness extending from an inner layer to an outer layer.

The polymer for forming the protective layer portion is preferably a polymer having a higher melting point out of two kinds of the polymers for constituting the alternate laminate portion. The use of a higher-melting-point polymer showing a higher cooling-to-solidification rate for forming the protective layer portion can minimize the deformation of the flat cross section caused by an interfacial energy and a Barus effect, so that the parallelism of the layers can be maintained. Further, the formation of the protective layer portion prevents the peeling and fracture of polymer layers in interfaces of the laminated portion and therefore improves the fiber in durability as well.

The thickness of the above protective layer as used in FIG. 2 is preferably 2 $\mu$m or more. When the thickness is smaller than 2 $\mu$m, the above effects are not all produced. On the other hand, when the thickness exceeds 10 $\mu$m, undesirably, the absorption and scattering of light in the region are no longer negligible. The above thickness is preferably 10 $\mu$m or less, more preferably 7 $\mu$m or less.

In the fiber having the above constitution of the present invention, the optical distance (refractive index of polymer forming each layer×thickness of each layer) of each of the alternately laminated layers is more uniform both in the major axis direction and in the minor axis direction of the flat cross section. As a result, the half-width $\lambda_{L=1/2}$ of reflection spectrum of the fiber converges in the range of 0 nm$<\lambda_{L=1/2}<$200 nm. When the half-width of the reflection spectrum exceeds 200 nm, the fiber forms multiple colors and the colors are cancelled one another, so that the color development is not recognizable to the naked eye.

The reflection spectrum of the fiber in the case of incidence 0 degree/light reception 0 degree will be explained as an example below. In this case, the light emission peak wavelength is related to the optical distance (=thickness) of layers of the alternate laminate portion, and the light emission intensity (relative reflectance when a reference white plate is used) is related to the number of layers of the alternate laminate portion. That is, the reflection spectrum represents the distribution of the member of said layers which satisfies a certain optical distance. When the half-width of the peak wavelength is broad, not only the development of multiple colors is observed, but also the color development intensity is decreased, so that it is no longer possible to obtain any excellent interference effect. When the color development occurs in the entire visible light region, a white color is formed, and the color development cannot be visually recognized. In the alternate laminate portion, however, the total number of layers having an optical distance (thickness) which forms a color of a certain wavelength is decreased, and the color development intensity (relative reflectance) is therefore also decreased as well.

The cross section of the fiber of the present invention is flat as shown in FIGS. 1 and 2, and it has a major axis (horizontal direction in Figures) and a minor axis (perpendicular direction in Figures). A flat fiber whose cross section has a high flattening ratio (major axis/minor axis) has the form of a preferred fiber cross section since a larger area effective for optical interference can be provided. The flattening ratio of the fiber is in the range of 4 to 15, preferably in the range of 7 to 10. When the flattening ratio exceeds 15, undesirably, the fiber productivity greatly decreases. When the protective layer portion is formed on the circumferential portion of the flat cross section as shown in FIG. 2, the protective layer portion is included to calculate the flattening ratio.

The fiber having the optical-interference function, provided by the present invention, has the above-described flat cross section and is structured as the alternate laminate. The structure of the flat cross section is particularly advantageous for a case where optically interfering filaments are bundled into a multi-bundle in particular. In the case of a mono-filament, the above structure is required mainly for the function of optical interference, while, in the case of a multi-filament yarn, it is required not only for the above reason but also for the orientation of flat major axis plane between constituent. That is, the optically interfering mono-filament has a flat cross section and has a structure in which polymer layers are alternately laminated in parallel with the major axis direction thereof. It therefore has optical interference characteristics that ① when the filament is viewed perpendicularly to a filament surface formed by its sides in its major axis direction and sides in the lengthwise direction of the filament, the most highest color development based on the optical interference function can be visually recognized, that ② when it is viewed at oblique angles, the effect thereof on the visual recognition sharply decreases, and further, that ③ when it is viewed toward a filament surface formed by sides in the minor axis direction of the flat cross section and its sides in the lengthwise direction of the filament, no optical interference function can be visually recognized.

Nevertheless, when optically interfering mono-filaments having a flat cross-section are combined to form a multi-filament yarn and then a fabric is made thereof, if the flattening ratio is smaller than 4 as is found in a conventional fiber, the mono-filaments are gathered together in a form in which they are close-packed in a multi-filament cross section due to a tension and a frictional force working on the filaments. When attention is paid to the filament surface formed by sides in the major axis direction of the flat cross section and sides in the lengthwise direction of the filament, therefore, the orientation degree on the above surface between constituent filaments is poor, and the orientation is directed in various directions. Thus, not only the optical interference function inherent to constituent filaments but also the orientation degree of the flat major axis surfaces of the constituent filaments as a yarn greatly works on the optical interference function of the multi-filament yarn.

However, when the above flattening ratio is 4.0 or more, preferably 5.0 or more, a self-orientation control function of each filament constituting the multi-filament starts to work on another filament constituting the multi-filament, and the constituent filaments are combined so as to bring flat major axis surfaces of the constituent filaments into a direction in parallel with one another, to constitute the multi-filament. That is, when the above filaments are pressed and tensioned with a take-up roller or a stretch roller in the step of forming the filaments, or when they are taken up around a bobbin in the form of cheese, or when the yarn is pressed on a yarn guide, etc., in the step of weaving a fabric, the filaments are always combined so as to make the flat major axis surface of each filament parallel with the pressing surface each time. Therefore, the parallelism of flat major axis surfaces of the constituent filaments increases, and these filaments come to show a superior optical interference function by axially twisting them.

Concerning the upper limit of the flattening ratio, when the value thereof exceeds 15.0, an extremely flat form is produced so that it is difficult to maintain the flat cross section, and there is possibility of partly bending in the cross section. In view of the above point, the flattening ratio for easy handling is 15 at the most, and it is particularly preferably 10.0 or less.

In the cross section of the fiber of the present invention, the number of individually independent polymer layers of the alternate laminate portion of the different polymer layers is preferably 5 or more and not more than 120. When the number of the laminated layers is smaller than 5, not only the interference effect is low, but also an interference color greatly changes depending upon viewing angles, and undesirably, only a cheap texture can be obtained. Further, it is preferred to alternately laminate 10 or more layers. On the other hand, the total number of the layers is 120 or less, particularly preferably 70 or less. When it exceeds 120, no further increase in light reflection quantity can be expected, and moreover, the spinneret structure comes to be complicated and spinning comes to be difficult. Further, undesirably, the flows of the layers are liable to have a turbulence. It is the most preferably 50 or less.

The present inventors have further made diligent studies for specific polymers having different refractive indices and having a solubility parameter value ratio in the above range, and as a result, have found that combinations of polymer A components and B components for fibers F-I to F-V to be explained below are remarkably excellent in view of fiber formability, easiness in forming stable layers of the alternate laminate portion in cross-sectional form, developability of obtained fibers for exhibiting optical interference, intensity of optical interference, affinity of polymers and the like. Combinations of polymers of these fibers F-I to F-V will be explained in detail hereinafter. In these fibers, a high refractive index polymer will be referred to as component A, and a low refractive index polymer will be referred to as component B. Further, the solubility parameter value of a high refractive index polymer will be represented as $SP_1$, and the solubility parameter value of a low refractive index polymer will be represented as $SP_2$.

(1) Fiber F-I

The fiber F-I is a fiber having the optical-interference function, in which polymers (component A and component B) forming independent polymer layers in a fiber cross section are polyethylene terephthalate (component A) copolymerized with a dibasic acid component having a sulfonic acid metal salt group in an amount of 0.3 to 10 mol % based on the total amount of the whole dibasic acid component forming the polyester, and polymethyl methacrylate (component B) having an acid value of at least 3.

The component A constituting the above fiber F-I is polyethylene terephthalate containing, as a comonomer component, a dibasic acid component having a sulfonic acid metal salt group.

The sulfonic acid metal salt group is a group of the formula —$SO_3M$, in which M is a metal and is preferably an alkali metal or an alkaline earth metal, particularly preferably an alkali metal (e.g., lithium, sodium or potassium). As part of the dibasic acid component for constituting the polyester, there is used a dibasic acid component having the above sulfonic acid salt group in a quantity of 1 or 2, preferably 1.

Specific examples of the dibasic acid component having the above sulfonic acid salt group include sodium 3,5-dicarbomethoxybenzenesulfonate, potassium 3,5-dicarbomethoxybenzenesulfonate, lithium 3,5-dicarbomethoxybenzenesulfonate, sodium 3,5-dicarboxybenzenesulfonate, potassium 3,5-dicarboxybenzenesulfonate, lithium 3,5-dicarboxybenzenesulfonate, sodium 3,5-di(β-hydroxyethoxycarbonyl)benzenesulfonate, potassium 3,5-di(β-hydroxyethoxycarbonyl)benzenesulfonate, lithium 3,5-di(β-hydroxyethoxycarbonyl)benzenesulfonate, sodium 2,6-dicarbomethoxynaphthalene-4-sulfonate, potassium 2,6-dicarbomethoxynaphthalene-4-sulfonate, lithium 2,6-dicarbomethoxynaphthalene-4-sulfonate, sodium 2,6-dicarboxynaphthalene-4-sulfonate, sodium 2,6-dicarbomethoxynaphthalene-l-sulfonate, sodium 2,6-dicarbomethoxynaphthalene-3-sulfonate, sodium 2,6-dicarbomethoxynaphthalene-4,8-disulfonate, sodium 2,6-dicarboxynaphthalene-4,8-disulfonate, sodium 2,5-bis(hydroxyethoxy)benzenesulfonate and α-sodium sulfosuccinate. Of these, sodium 3,5-dicarbomethoxybenzenesulfonate, sodium 3,5-dicarboxybenzenesulfonate and sodium 3,5-di(β-hydroxyethoxycarbonyl)benzenesulfonate are preferred. The above sulfonic acid metal salts may be used alone or in combination.

The above dibasic acid component having a sulfonic acid metal salt group is copolymerized in an amount of 0.3 to 10 mol % based on the total amount of the whole dibasic acid component forming the polyethylene terephthalate. When the amount for the copolymerization is smaller than 0.3 mol %, the polyethylene terephthalate is insufficient in adhesion to polymethyl methacrylate (component B) and poor in layer formability, and it is difficult to form multi-layers. On the other hand, when the above amount exceeds 10 mol %, the polyethylene terephthalate has too high a melt viscosity, and undesirably, there is caused a great difference from the component B in flowability. The comonomer ratio of the dibasic acid component having the sulfonic acid metal salt group is preferably in the range of from 0.5 to 5 mol %.

The polyethylene terephthalate copolymer as component A is formed mainly from terephthalic acid component, ethylene glycol component and a dibasic acid component having the above sulfonic acid metal salt group, and not more than 30 mol %, based on the total amount of the carboxylic acid components or the total amount of the glycol components, of other component may be copolymerized. When the amount of the other monomer component exceeds 30 mol %, undesirably, the polyester as a main component is greatly degraded in the properties of heat resistance, spinning performance and refractive index. The amount of the other comonomer component is more preferably 15 mol % or less.

Examples of the other comonomer component include aromatic dicarboxylic acids such as isophthalic acid, biphenyldicarboxylic acid, 4,4'-diphenyl ether dicarboxylic acid, 4,4'-diphenylmethanedicarboxylic acid, 44,4'-diphenylsulfonedicarboxylic acid, 1,2-diphenoxyethane-4', 4"-dicarboxylic acid, anthracenedicarboxylic acid, 2,5-pyridinedicarboxylic acid, 2,6-naphthalenedicarboxylic acid, 2,7-naphthalenedicarboxylic acid and diphenylketonedicarboxylic acid; aliphatic dicarboxylic acids such as malonic acid, succinic acid, adipic acid, azelaic acid and sebacic acid; alicyclic dicarboxylic acids such as decalindicarboxylic acid. hydroxycarboxylic acids such as β-hydroxyethoxybenzoic acid, p-hydroxybenzoic acid and hydroxypropionic acid; ester-forming derivatives of these; and the like. The above aromatic dicarboxylic acid units may be used alone or in combination in the copolymer.

The aliphatic diol component used for the copolymerization includes aliphatic diols such as trimethylene glycol, tetramethylene glycol, hexamethylene glycol, diethylene glycol and polyethylene glycol; aromatic diols such as hydroquinone, catechol, naphthalenediol, resorcin, bisphenol A and an adduct of bisphenol A with ethylene oxide; and alicyclic diols such as cyclohexanedimethanol. These diols may be used alone or in combination, and the total sum thereof based on the total diol amount is preferably 30 mol % or less, more preferably 15 mol % or less.

In the present invention, further, polyvalent carboxylic acids such as trimellitic acid, trimesic acid, pyromellitic acid and tricarballylic acid; and polyhydric alcohols such as glycerin, trimethylolethane, trimethylolpropane and pentaerythritol may be contained as a comonomer so long as the polyethylene terephthalate copolymer is substantially linear.

In the polymethyl methacrylate (component B) having an acid value of at least 3, the acid value thereof can be increased by using a monovalent acid such as methacrylic acid or acrylic acid or divalent acid such as maleic acid as part of comonomers. The above acid value is preferably 3 or more. When the above acid value is lower than 3, the affinity between the polyethylene terephthalate and the polymethyl methacrylate under ionic force is deficient, and no sufficient alternate multi-layers can be formed. On the other hand, when the acid value exceeds 20, the heat resistance is decreased to a great extent, and the spinning performance is liable to be degraded. Further, the acid value is preferably at least 4 and not more than 15.

In the fiber F-I, when two kinds of polymers of the above component A and the above component B are combined, a sufficient difference in refractive index can be attained when the fiber is formed, i.e., orientation is carried out. In the above combination, further, there can be obtained an alternate laminate which has a large interfacial area and works effectively on reflection.

(2) Fiber F-II

The fiber F-II is a fiber having the optical-interference function, in which polymers (component A and component B) forming independent polymer layers in a fiber cross section are polyethylene naphthalate (component A) copolymerized with a dibasic acid component having a sulfonic acid metal salt group in an amount of 0.3 to 5 mol % based on the total amount of the whole dibasic acid component forming the polyester, and an aliphatic polyamide (component B).

The component A constituting the above fiber F-II is polyethylene naphthalate containing, as a comonomer component, a dibasic acid component having a sulfonic acid metal salt group. The main component for forming the polyethylene naphthalate is preferably ethylene-2,6-naphthalate or ethylene-2,7-naphthalate, particularly preferably ethylene-2,6-naphthalate.

The sulfonic acid metal salt group is a group of the formula —$SO_3M$, in which M is a metal and particularly, it is preferably an alkali metal or an alkaline earth metal, particularly preferably an alkali metal (e.g., lithium, sodium or potassium). As part of the dibasic acid component for constituting the polyester, there is used a dibasic acid component having the above sulfonic acid salt group in a quantity of 1 or 2, preferably 1.

Specific examples of the dibasic acid component having the above sulfonic acid salt group include sodium 3,5-dicarbomethoxybenzenesulfonate, potassium 3,5-dicarbomethoxybenzenesulfonate, lithium 3,5-dicarbomethoxybenzenesulfonate, sodium 3,5-dicarboxybenzenesulfonate, potassium 3,5-dicarboxybenzenesulfonate, lithium 3,5-dicarboxybenzenesulfonate, sodium 3,5-di(β-hydroxyethoxycarbonyl)benzenesulfonate, potassium 3,5-di(β-hydroxyethoxycarbonyl)benzenesulfonate, lithium 3,5-di(β-hydroxyethoxycarbonyl)benzenesulfonate, sodium 2,6-dicarbomethoxynaphthalene-4-sulfonate, potassium 2,6-dicarbomethoxynaphthalene-4-sulfonate, lithium 2,6-dicarbomethoxynaphthalene-4-sulfonate, sodium 2,6-dicarboxynaphthalene-4-sulfonate, sodium 2,6-dicarbomethoxynaphthalene-1-sulfonate, sodium 2,6-dicarbomethoxynaphthalene-3-sulfonate, sodium 2,6-dicarbomethoxynaphthalene-4,8-disulfonate, sodium 2,6-dicarboxynaphthalene-4,8-disulfonate, sodium 2,5-bis(hydroxyethoxy)benzenesulfonate and α-sodium sulfosuccinate. Of these, sodium 3,5-dicarbomethoxybenzenesulfonate, sodium 3,5-dicarboxybenzenesulfonate and sodium 3,5-di(β-hydroxyethoxycarbonyl)benzenesulfonate are preferred. The above sulfonic acid metal salts may be used alone or in combination.

The above dibasic acid component having a sulfonic acid metal salt group is copolymerized in an amount of 0.3 to 5 mol % based on the total amount of the whole dibasic acid component for forming the polyethylene terephthalate. When the amount for the copolymerization is smaller than 0.3 mol %, the polyethylene naphthalate is insufficient in adhesion to the aliphatic polyamide (component B) and poor in layer formability, and it is difficult to form multi-layers. On the other hand, when the above amount exceeds 5 mol %, the polyethylene naphthalate has too high a melt viscosity, and undesirably, there is caused a great difference from the component B in flowability. The comonomer ratio of the dibasic acid component having the sulfonic acid metal salt group is preferably in the range of from 0.5 to 3.5 mol %.

The polyethylene naphthalate copolymer as component A is formed mainly from a naphthalenedicarboxylic acid component, an ethylene glycol component and a dibasic acid component having the above sulfonic acid metal acid group, and not more than 30 mol %, based on the total amount of the carboxylic acid components or the total amount of the glycol components, of other component may be copolymerized. When the amount of the other comonomer component exceeds 30 mol %, undesirably, the polyester as a main component is greatly degraded in the properties of heat resistance, spinning performance and refractive index. The amount of the other comonomer component is more preferably 15 mol % or less.

Examples of the other comonomer component include aromatic dicarboxylic acids such as terephthalic acid, isophthalic acid, biphenyldicarboxylic acid, 4,4'-diphenyl ether dicarboxylic acid, 4,4'-diphenylmethanedicarboxylic acid, 4,4'-diphenylsulfonedicarboxylic acid, 1,2-diphenoxyethane-4',4"-dicarboxylic acid, anthracenedicarboxylic acid, 2,5-pyridinedicarboxylic acid and diphenylketonedicarboxylic acid; aliphatic dicarboxylic acids such as malonic acid, succinic acid, adipic acid, azelaic acid and sebacic acid; alicyclic dicarboxylic acids such as decalindicarboxylic acid; hydroxycarboxylic acids such as β-hydroxyethoxybenzoic acid, p-hydroxybenzoic acid and hydroxypropionic acid; ester-forming derivatives of these; and the like. The above aromatic dicarboxylic acid units may be contained alone or in combination in the copolymer.

The aliphatic polyamide (component B) generally has a low melting point, and at a high temperature of over 250° C., it is liable to undergo pyrolysis. Further, the polyethylene naphthalate is required to be melted at a high temperature due to its high rigidity and high crystallinity. It is therefore preferred to produce the polyethylene naphthalate by copolymerization. So as to obtain a polyethylene naphthalate copolymer preferably having a melting point of not more than 250° C., and for this purpose, the amount of comonomer to be copolymerized is 8 mol % or more, more preferably 10 mol % or more.

The aliphatic diol component used for the copolymerization includes aliphatic diols such as trimethylene glycol, tetramethylene glycol, hexamethylene glycol, diethylene glycol and polyethylene glycol; aromatic diols such as hydroquinone, catechol, naphthalenediol, resorcin, bisphenol A and an adduct of bisphenol A with ethylene oxide; and alicyclic diols such as cyclohexanedimethanol. These diols may be used alone or in combination, and the total sum thereof based on the total diol amount is preferably 30 mol % or less, more preferably 15 mol % or less, and it is preferably 8 mol % or more, more preferably 10 mol % or more.

In the present invention, further, polyvalent carboxylic acids such as trimellitic acid, trimesic acid, pyromellitic acid and tricarballylic acid; and polyhydric alcohols such as glycerin, trimethylolethane, trimethylolpropane and pentaerythritol may be contained as a comonomer so long as the polyethylene naphthalate copolymer is substantially linear.

The component B for constituting the fiber F-II is an aliphatic polyamide, and specific examples thereof include nylon 6, nylon 66, nylon 612, nylon 11 and nylon 12. Of these, nylon 6 and nylon 66 are preferred.

As an aliphatic polyamide, nylon 6 is particularly preferred since it has an inherent birefringence of as low as 0.067 to 0.096.

In the fiber F-II, when two kinds of polymers of the above component A and the above component B are combined, a sufficient difference in birefringence can be attained when the fiber is formed, i.e., even when orientation is carried out. In the above combination, further, there can be obtained an alternate laminate which has a large interfacial area and works effectively on reflection.

(3) Fiber F-III

The fiber F-III is a fiber having the optical-interference function, in which polymers (component A and component B) forming independent polymer layers in a fiber cross section are an aromatic copolyester (component A) comprising, as a comonomer component(s), a dibasic acid component having at least one alkyl group as a side chain and/or glycol component having at least one alkyl group as a side chain and containing the above copolymer component (s) in an amount of 5 to 30 mol % based on the total amount of all the recurring units and polymethyl methacrylate (component B).

The component A constituting the fiber F-III is an aromatic copolyester having, as a copolymer component(s), a dibasic acid component having at least one alkyl group as a side chain and/or a glycol component having at least one alkyl group as a side chain, and containing the above copolymer component(s) in an amount of 5 to 30 mol % based on the total amount of recurring units.

The aromatic copolyester forming a polymer structure of the component A is formed from an aromatic dibasic acid component and an aliphatic glycol component. Specifically, it includes polyethylene terephthalate, polybutylene terephthalate and polyethylene naphthalate, and polyethylene terephthalate is particularly preferred. As a component A in the present invention, an aromatic copolyester containing the above copolymer component is used. The alkyl group as a side chain in the copolymer component preferably includes methyl, ethyl, propyl, butyl, pentyl, hexyl and a higher alkyl group having carbon atoms in a further greater number. Further, an alicyclic alkyl group such as cyclohexyl is also preferred as well. However, a group having too large a size is not preferred as a side chain group since it greatly inhibits the orientation crystallization of the aromatic polyester. Of the above alkyl groups, methyl is particularly preferred. The number of alkyl groups as a side chain may be 1 or more, and it is preferably 1 or 2.

The polymethyl methacrylate (PMMA) as component (B) forms a spiral structure, and a methyl group can be positioned in the outside direction of the spire. Therefore, the interaction between the polymethyl methacrylate and the aromatic polyester having, as a comonomer(s), a dibasic acid component and/or glycol component, both of which have an alkyl group, methyl in particular, as a side chain copolymerized can be increased.

As dibasic acid component having an alkyl group as a side chain in the copolymer component of the component A, a dibasic acid having a side chain alkyl group from an aliphatic hydrocarbon, such as 4,4'-diphenylisopropylidenedicarboxylic acid, 3-methylglutaric acid or methyl malonate is preferred since the alkyl group can be easily directed outwardly from the molecule so that the dibasic acid can easily interact with the component B (PMMA). As a glycol having an alkyl group, methyl in particular, as a side chain, a glycol having a side chain alkyl group from an aliphatic hydrocarbon, such as neopentyl glycol, bisphenol A or an adduct of bisphenol A with ethylene oxide is particularly preferred since the interaction between the above glycol and the component B (PMMA) is large. It is presumably because these compounds have two methyl groups as side chains so that the effect thereof can be fully exhibited.

The aromatic polyester preferably comprises the copolymer component(s) having an alkyl group as a side chain in an amount of at least 5 mol % and not more than 30 mol % based on the total amount of all the recurring units. When the amount is smaller than 5 mol %, undesirably, the affinity between the component A (aromatic copolyester component) and the component B (PMMA) is not sufficient. On the other hand, when the amount exceeds 30 mol %, undesirably, the aromatic polyester as a main component is greatly degraded in the properties of heat resistance and spinning performance. The amount of the copolymer component is preferably at least 6 mol % and not more than 15 mol %.

Further, there may be used a polymer obtained by copolymerizing the above aromatic copolyester and other component. The above other copolymer component is an acid other than the dibasic acid used for constituting the aromatic polyester, and it includes terephthalic acid, isophthalic acid, biphenyldicarboxylic acid, 4,4'-diphenyl ether dicarboxylic acid, 4,4'-diphenylmethanedicarboxylic acid, 4,4'-diphenylsulfonedicarboxylic acid, 1,2-diphenoxyethane-4',4"-dicarboxylic acid, anthracenedicarboxylic acid, 2,5-pyridinedicarboxylic acid, diphenylketonedicarboxylic acid and sodium sulfoisophthalic acid; aliphatic dicarboxylic acids such as malonic acid, succinic acid, adipic acid, azelaic acid and sebacic acid; alicyclic dicarboxylic acids such as decalindicarboxylic acid; hydroxycarboxylic acids such as β-hydroxyethoxybenzoic acid, p-hydroxybenzoic acid and hydroxypropionic acid; ester-forming derivatives of these; and the like. The above aromatic dicarboxylic acid units may be contained alone or in combination. The amount thereof based on the total amount of all the dibasic acid components is 30 mol % or less, preferably 15 mol % or less. When the above amount exceeds 30 mol %, undesirably, the properties of the main component can no longer be sufficiently retained.

The aliphatic diol component that can be copolymerized as component A is a glycol other than the glycol component which constitutes the polyester, and it includes aliphatic diols such as ethylene glycol, trimethylene glycol, tetramethylene glycol, hexamethylene glycol, diethylene glycol and polyethylene glycol; aromatic diols such as hydroquinone, catechol, naphthalenediol, resorcin, bisphenol S and an adduct of bisphenol S with ethylene oxide; alicyclic diols such as cyclohexanedimethanol; and the like. These diols are preferably used alone or in combination in a copolymerization amount of 30 mol % or less, more preferably 15 mol % or less, based on the total amount of all the diol components.

In the present invention, further, polyvalent carboxylic acids such as trimellitic acid, trimesic acid, pyromellitic acid and tricarballylic acid; and polyhydric alcohols such as glycerin, trimethylolethane, trimethylolpropane and pentaerythritol may be contained so long as the aromatic copolyester is substantially linear.

The component B constituting the fiber F-III is polymethyl methacrylate (PMMA), and part of this polymer may be copolymerized with methacrylic acid, acrylic acid or maleic acid.

In the fiber F-III, when the two kinds of polymers of the above component A and the above component B are combined, a sufficient difference in refractive index can be attained when the fiber is formed, i.e., orientation is carried out. In the above combination, there can be obtained an alternate laminate which has a large interfacial area and works effectively on reflection.

(4) Fiber F-IV

The fiber F-IV is a fiber having the optical-interference function, in which polymers (component A and component B) forming independent polymer layers in a fiber cross section are polycarbonate (component A) obtained from 4,4'-hydroxydiphenyl-2,2-propane as a dihyric phenol component and polymethyl methacrylate (component B).

The component A constituting the fiber F-IV is polycarbonate formed mainly from 4,4'-dihydroxydipehnyl-2,2-propane (bisphenol A) as a dihydric phenol component. Other diol components may be copolymerized so long as the properties thereof are not impaired. As examples thereof, aliphatic diols such as ethylene glycol, trimethylene glycol, tetramethylene glycol, hexamethylene glycol, diethylene glycol and polyethylene glycol; aromatic diols such as hydroquinone, catechol, naphthalenediol, resorcin, bisphenol S and an adduct of bisphenol S with ethylene oxide; and alicyclic diols such as cyclohexanedimethanol may be used.

These diols for the copolymerization may be used alone or in combination, and the copolymerization amount thereof based on the total diol amount is preferably 30 mol % or less, more preferably 15 mol % or less.

The component B constituting the fiber F-IV is a polymer formed mainly from methyl methacrylate as a monomer, and other vinyl monomer, particularly, methyl acrylate or fluorine-substituted methyl methacrylate (which is particularly preferred since it has a still lower refractive index), may be contained as other comonomers. These comonomers may be used alone or in combination, and the amount thereof based on the total amount of all the monomer units is preferably 30 mol % or less, more preferably 15 mol % or less.

In the fiber F-IV, when two kinds of polymers of the above component A and the above component B are combined, a sufficient difference in birefringence can be attained when the fiber is formed, i.e., even when orientation is carried out. In the above combination, there can be obtained an alternate laminate which has a large interfacial area and works effectively on reflection.

(5) Fiber F-V

The fiber F-V is a fiber having the optical-interference function, in which polymers (component A and component B) forming independent polymer layers in the fiber cross section are polyethylene terephthalate (component A) and aliphatic polyamide (component B).

The polyethylene terephthalate as component A is a polyester formed of a terephthalic acid component as a dibasic acid component and an ethylene glycol component as a glycol component, and may contain, as a comonomer component, other component in an amount of not more than 30 mol % based on the total amount of all the dibasic acid component or all the glycol component. When the amount of the other comonomer component exceeds 30 mol %, undesirably, the polyester as a main component is greatly degraded in the properties of heat resistance, spinning performance and refractive index. The amount of the other comonomer component is more preferably 15 mol % or less, particularly preferably 10 mol % or less.

The other comonomer component includes aromatic dicarboxylic acids such as isophthalic acid, biphenyldicarboxylic acid, 4,4'-diphenyl ether dicarboxylic acid, 4,4'-diphenylmethanedicarboxylic acid, 4,4'-diphenylsulfonedicarboxylic acid, 1,2-diphenoxyethane-4', 4"-dicarboxylic acid, anthracenedicarboxylic acid, 2,5-pyridinedicarboxylic acid, 2,6-naphthalenedicarboxylic acid, 2,7-naphthalenedicarboxylic acid and diphenylketonedicarboxylic acid; aliphatic dicarboxylic acids such as malonic acid, succinic acid, adipic acid, azelaic acid and sebacic acid; alicyclic dicarboxylic acids such as decalindicarboxylic acid; hydroxycarboxylic acids such as β-hydroxyethoxybenzoic acid, p-hydroxybenzoic acid and hydroxyproplonic acid; ester-forming derivatives of these; and the like. The above aromatic dicarboxylic acid units may be used alone or in combination in the copolymer.

The aliphatic diol component used for the copolymerization includes aliphatic diols such as trimethylene glycol, tetramethylene glycol, hexamethylene glycol, diethylene glycol and polyethylene glycol; aromatic diols such as hydroquinone, catechol, naphthalenediol, resorcin, bisphenol A and an adduct of bisphenol A with ethylene oxide; alicyclic diols such as cyclohexanedimethanol; and the like. These diols may be used alone or in combination, and the total sum thereof based on the total diol amount is preferably 30 mol % or less, more preferably 15 mol % or less, particularly preferably 10 mol % or less.

In the present invention, further, polyvalent carboxylic acids such as trimellitic acid, trimesic acid, pyromellitic acid and tricarballylic acid; and polyhydric alcohols such as glycerin, trimethylolethane, trimethylolpropane and pentaerythritol may be contained as long as the polyethylene terephthalate copolymer is substantially linear.

The component B for constituting the fiber F-V is an aliphatic polyamide, and specific examples thereof include nylon 6, nylon 66, nylon 6-12, nylon 11 and nylon 12. Of these, nylon 6 and nylon 66 are preferred.

As an aliphatic polyamide, nylon 6 is particularly preferred since it has an inherent birefringence of as low as 0.067 to 0.096.

In the fiber F-V, when two kinds of polymers of the above component A and the above component B are combined, a sufficient difference in birefringence can be attained when the fiber is formed, i.e., even when orientation is carried out. In the above combination, there can be obtained an alternate laminate which has a large interfacial area and works effectively on reflection.

The method of producing the fiber having the optical-interference function of the present invention will be explained hereinafter.

Basically, the intended fiber having the optical-interference function can be obtained by melt-extruding a high refractive index polymer (component A) and a low refractive index polymer (component B) through a spinneret in a flat form so as to laminate layers alternately in parallel with the lengthwise direction of the flat cross section thereof and spinning an extrudate while maintaining the parallelistic relation (interfacial uniformity) between the flat cross section and the alternately laminated layers.

In the production of flat fiber formed by alternately laminating two kinds of polymers in parallel with the major axis direction of its flat cross section, however, if layers of polymers having different refractive indices are used only to extrude the polymer layers alternately laminated from a spinneret having a rectangular form, the resultant cross-sectional form is deformed to be elliptical or circular. Consequently, the interface of the alternately laminated layers becomes devoid of parallelism and results in the formation of curved laminate interfaces. That is, it is very difficult to obtain a fiber having the optical-interference function. In particular, it is very difficult to spin a fiber which has a flat cross section and which is excellent in the function of optical interference and has a large flattening ratio or to spin it not as a mono-filament but as a multi-filament.

According to the studies made by the present inventors, it has been found that there can be obtained a spinning method which can maintain both the properties of flat cross section and the properties of alternate lamination (interfacial uniformity) by bringing the ratio (SP ratio=$SP_1/SP_2$) of the solubility parameter value ($SP_1$) of the high refractive index polymer (component A) and the solubility parameter value ($SP_2$) of the low refractive index polymer (component B) into a predetermined range and by bringing a difference (absolute value) between the melting point ($MP_1$) of the high refractive index polymer (component A) and the melting point ($SP_2$) of the low refractive index polymer (component B) into a predetermined range.

It has been accordingly found that the fiber having the optical-interference function of the present invention can be obtained by a spinning method in which a flat fiber formed by alternately laminating two kinds of polymers having different refractive indices in parallel with the major axis of the flat cross section thereof, the spinning being carried out with (a) maintaining the ratio (SP ratio) of the solubility parameter value ($SP_1$) of the high refractive index polymer (component A) and the solubility parameter value ($SP_2$) of the low refractive index polymer (component B) in the range of $0.8 \leqq SP_1/SP_2 \leqq 1.2$, and (b) maintaining the absolute value of a difference (MP difference) between the melting point ($MP_1$) of the high refractive index polymer (component A) and the melting point ($MP_2$) of the low refractive index polymer (component B) in the range of $0° C. \leqq |MP_1-MP_2| \leqq 70° C.$ The method of spinning the fiber having the optical-interference function of the present invention will be explained more in detail with reference to drawings hereinafter.

The fiber having the optical-interference function, provided by the present invention, has a flat cross section, and in the alternate laminate portion of layers of polymers having different refractive indices, the layers are alternately laminated in parallel with the major axis of the flat cross section, as shown in FIGS. 1 and 2, whereby a wide area effective for optical interference is constituted. And, the parallelism of the alternate laminating is particularly important for the optical interference function, and the above spinning method is a means of securing the above flat cross-sectional form and the parallelism of the alternate laminating.

In the above spinning method, two requirements are particularly essential. One is to spin a fiber with maintaining the ratio (SP ratio) of the solubility parameter value ($SP_1$) of the high refractive index polymer (component A) and the solubility parameter value ($SP_2$) of the low refractive index polymer (component B) in the range of $0.8 \leqq SP_1/SP_2 \leqq 1.2$.

When alternately laminated flows of two kinds of polymers are finally extruded through a rectangular spinneret that will be explained later, generally, each polymer flow tends to round itself due to a surface tension with ambient air, and a shrinking force works toward an interfacial direction so as to minimize the contact area of the interface of both the polymers. Further, the shrinking force is magnified due to the presence of multi-layers, and lamination surfaces tend to round themselves with forming curved surfaces. Further, the polymer flows tend to swell due to a Barus effect when released from a spinneret outlet. Against the behavior of the polymer flows immediately after the spinneret, spinning is carried out while maintaining the SP ratio ($SP_1/SP_2$) in the range of $0.8 \leqq SP_1/SP_2 \leqq 1.2$, whereby the spinning can be carried out with preventing the behavior of laminated layers tending to round themselves due to an interfacial tension. Further, the spinning can be more preferably carried out when the SP ratio is set in the range of $0.8 \leqq SP_1/SP_2 \leqq 1.1$.

The other requirement is to spin a fiber while maintaining the absolute value of a difference (MP difference) between the melting point ($MP_1$) of the high refractive index polymer (component A) and the melting point ($MP_2$) of the low refractive index polymer (component B) in the range of $0° C. \leqq |MP_1-MP_2| \leqq 70°C$. As described above, the flat cross section of the polymer flows tends to round immediately after the polymer flows are extruded through a spinneret, and the alternately laminated layers which are parallel with one another tend to curve themselves as a whole. If both the spun polymers are cooled to solidification as soon as possible, the above disadvantages can be inhibited to that extent. That is, when the temperatures at which the two polymers are cooled to solidification are close to each other, the difference of the polymer from the spinneret temperature can be accordingly decreased. The alternately laminated layers as a whole can be therefore rapidly cooled to solidification, so that the behavior of the alternately laminated layers curving and rounding themselves can be inhibited. This inhibition effect can be more effectively exhibited when the above MP difference is brought into the range of $0° C. \leqq |MP_1-MP_2| \leqq 40° C$. Naturally, the case where the melting points of the two polymers are equal, i.e., MP difference=0, is the most preferred.

Further, when polymers having no clear melting points, such as amorphous polymers, are used, their glass transition temperatures (Tg) can be used in place of the melting point. When Tg of a polymer having a higher Tg (component A) is taken as $Tg_1$ and Tg of a polymer having a lower Tg (component B) is taken as $Tg_2$, it is preferred to satisfy the range of $0° C. \leqq Tg_1-Tg_2| \leqq 40° C$.

When a fiber is spun with maintaining the SP ratio and the MP difference in the above ranges as described above, the spinning can be carried out with maintaining the flat cross-sectional form and the parallelisms of layers of the alternate laminate portion.

Further, as an auxiliary means useful for maintaining the flat cross-sectional form of the fiber and the parallelism of layers of the alternate laminate portion, there is a means of spinning the fiber while forming a protective layer portion formed of one of the polymers for forming the laminate-forming polymers on the circumference of the alternate laminate portion of the flat cross section.

The alternate laminate polymer flow extruded through the spinneret receives a frictional force with the wall inside the spinneret, and in this case, since the flow rates differ between the vicinity of the wall and the central portion of the polymer flow, the polymer flows at a larger amount in the central portion of the alternate laminate and flows at a smaller amount in the circumferential portion thereof. As a result, the alternately laminated layers have nonuniformity in thickness. This problem can be controlled by spinning a fiber while forming the protective layer portion on the circumferential portion of the flat cross section. Further, in this case, when the polymer having a higher melting point (component A) is used for forming the protective layer portion, the cooling of the fiber to solidness proceeds faster, and the form of the flat cross section and the parallelism of layers of the alternate laminate portion can be more advantageously maintained.

The above protective layer portion preferably has a thickness of 2 $\mu$m or more. When the thickness is smaller than 2 $\mu$m, undesirably, the above effect is scarcely produced. The thickness of the protective layer is preferably 3 $\mu$m or more. When the thickness exceeds 10 $\mu$m, undesirably, the absorption of light and the irregular reflection of light in the layer are no longer negligible. The thickness is preferably 10 $\mu$m or less, more preferably 7 $\mu$m or less.

In the method of spinning the fiber having the optical-interference function of the present invention, means of forming the alternate laminates having a flat cross section will be explained below.

FIG. 7 shows a vertical cross-sectional view of a spinneret. The spinneret has an upper distributor 9, a lower distributor 10, an upper spinneret member 6, a central spinneret member 7 and a lower spinneret member 8 which are all in the form of a disk, and these are integrally clamped with bolts 12. FIG. 8(*a*) is a plan-cross-sectional view of the upper spinneret member 6 of FIG. 7 viewed from above, and shows that pairs of nozzle plates 1 and 1' are radially disposed. FIG. 8(*b*) is an enlarged view of the nozzle plates 1 and 1'. FIG. 9(*a*) shows a cross section of laminated polymer flows when the laminated polymer flows are extruded through the nozzle plates 1 and 1', and FIG. 9(*b*) shows a cross section of the polymer flows when the polymer flows are finally extruded through an extrusion opening 11. FIG. 10 is a partial vertical cross-sectional view of a spinneret for forming a protective layer on the circumferential portion of an alternate laminate portion.

In these Figures, for alternately laminating two kinds of molten polymers, the nozzle plates 1 and 1' are provided, in a direction forming a right angle with the paper surface, with groups of openings 2 and 2' in a number corresponding to layers to be laminated, which openings are connected to feed paths 19 and 19'. In this case, the groups of openings 2 and 2' are arranged so that they face each other alternately (biasedly) as shown in FIG. 4(*b*). Molten polymer A is supplied to either one of a pair of the above nozzle plate 1 and 1', and molten polymer B is supplied to the other. For this purpose, flow paths 3 and 3' in a number equal to the number of a pair of the above nozzle plates 1 and 1' are disposed through the upper distributor 9 and the lower distributor 10. In the nozzle plates 1 and 1', the molten polymers A and B join to have a laminated form. For decreasing the thickness of each polymer layer in this case, the central spinneret member 7 is provided with a "funnel-shaped portion 4" whose flow path is narrowed in a tapered shape, correspondingly to the above nozzle plates 1 and 1'. Further, the lower spinneret member 8 is provided with the extrusion opening 11, correspondingly to the funnel-shaped portion 4.

In the above spinneret, polymer A is distributed to each nozzle plate 1 through a flow path 3 provided through the upper distributor 9 and the lower distributor 10, and polymer B is also distributed to each nozzle plate 1' through a flow path 3' likewise. Then, polymers A and B extruded from the nozzle plates 1 and 1' are alternately laminated, and further, layers are decreased in thickness while they pass the funnel-shaped portion 4, and extruded through the extrusion opening 11. In this case, the extrusion opening has a rectangular form (e.g., dimensions of 0.13 mm×2.5 mm), and polymers are extruded so as to spread in the major axis direction of a flat cross section and extruded as an alternate laminate portion.

In the above case, the cross section of flows of molten polymers A and B extruded through groups of the openings 2 and 2' has a structure shown in FIG. 9(*a*). Then; the flows pass the funnel-shaped portion 4, whereby the width of the molten polymer flows in FIG. 9(*a*) is narrowed in an direction pointed by an arrow, and as a result, the cross section of a fiber spun through the extrusion opening 11 has a structure shown in FIG. 9(B).

When the protective layer portion as shown in FIG. 2 is formed on the circumferential portion of the alternate laminate portion in a cross section, it is obtained by using a nozzle plate 8' as shown in FIG. 10 and allowing polymer to form the protective layer portion through other paths, i.e., paths 13, 14, 15 and 16.

Further, when the protective layer portion is formed on the circumferential portion of the alternate laminate portion as shown in FIG. 2, it is obtained by increasing the sizes of both ends of the opening portion of one of the nozzle plates 1 and 1'.

In the above spinneret, polymer A is distributed to each nozzle plate 1 through a flow path 3 provided through the upper distributor 9 and the lower distributor 10, and polymer B is also distributed to each nozzle plate 1' through a flow path 3'. Then, polymers A and B extruded through the nozzle plates 1 and 1' are alternately laminated and further, while they pass the funnel-shaped portion 4, layers are decreased in thickness and extruded through the extrusion opening 11. In this case, the extrusion opening has a rectangular form (e.g., dimensions of 0.13 mm×2.5 mm), and polymers are extruded so as to spread in the major axis direction of a flat cross section and extruded as an alternate laminate portion.

When the protective layer portion formed of component A, component B or other component is formed on the circumferential portion of the alternate laminate portion in a cross section, it may be formed by closing both ends of each opening of the group of openings 2 or 2' of one of the nozzle plates 1 and 1', or, in a circumferential portion, it may be formed by allowing polymer for forming the protective layer portion to flow through other route in the lower spinneret member 8.

The alternate laminate flows extruded through the extrusion openings 11 of the spinneret are cooled to solidification, then taken up with a take-up roller and wound up on a cheese. Concerning the take-up rate, the fiber can be taken up at a rate in the range of 1,000 to 8,000 m/minute like the spinning of general synthetic fibers. At a low spinning rate, however, no tension is exerted on the alternate laminates which are still in a molten state in the extrusion opening, and a well-balanced parallel laminate is secured. Generally preferably, the fiber is taken up at a rate in the range of 1,000 to 1,500 m/minute and then wound up with drawing it through a roller. Otherwise, an undrawn fiber which is spun and taken up is once wound up and then drawn at a draw rate of 200 to 1,000 m/minute in a separate step.

The combination of the polymers having difference refractive indices, used in the method of spinning the fiber of the present invention, will be explained.

In general, polymers have a refractive index in the range of 1.30 to 1.82, and of these, generally used polymers have a refractive index in the range of 1.35 to 1.75. Of these polymers, a combination of two polymers are selected such that the refractive index ratio $n_1/n_2$ of the two polymers is within 1.1 to 1.4 in which $n_1$ is a refractive index of a high refractive index polymer component (component A) and $n_2$ is a refractive index of a low refractive index polymer (component B).

The layer thickness of the alternate laminates of component A and component B is designed according to optical interference theory. When the refractive index of the polymer A component is taken as $n_1$, its layer thickness in the laminate as $d_1$ ($\mu$m), the refractive index of the polymer B component as $n_2$ and its layer thickness in the laminate as $d_2$ ($\mu$m), $d_1$ and $d_2$ are determined so as to satisfy the following equation, $$\lambda=2(n_1d_1+n_2d_2)=2n_1[d_1+d_2(n_2/n_1)]$$

wherein $\lambda$ ($\mu$m) is a wavelength of a color to be formed by optical interference. When the optical thickness (refractive index×thickness, i.e., $n_1d_1$ and $n_2d_2$) of one component is the same as that of the other, i.e., when $\lambda/4=n_1d_1=n_2d_2$, a maximum interference color development can be obtained.

A flat cross section having a larger flattening ratio is preferred as a fiber cross-sectional form since the area effective for optical interference can be increased with an increase in the flattening ratio of the flat cross section. The flattening ratio of the flat fiber is preferably 4 or more, more preferably 7 or more, as already described. The flattening ratio is preferably 15 or less, more preferably 10 or less.

Further, concerning the number of laminated layers, it is preferred that 5 or more layers formed of each of components A and B are alternately laminated. When the number of the layer is less than 5, undesirably, not only the interference effect is low, but also an interference color greatly changes depending viewing angles so that only a cheap texture is obtained. More preferably, 10 or more layers of each are alternately laminated. The total number of the layers is preferably 120 or less. When it exceeds 120, undesirably, an increase in the reflection quantity of light is no longer expected, the spinneret structure is complicated so that spinning is difficult, and a turbulence is liable to occur in layer flows. It is more preferably 70 or less, particularly preferably 50 or less.

When the fiber having the optical-interference function of the present invention is taken as a single-filament or mono-filament, it is a flat optically interfering fiber formed by alternately laminating individually independent layers of polymers having different refractive indices in parallel with the major axis direction of the flat cross section as is already described, and it has a characteristic feature in a combination of two kinds of polymers forming different polymer layers.

The fiber having the optical-interference function of the present invention, as a single-filament or mono-filament, has the function of optical interference by itself, and when it is used in the form of a multi-filament yarn or a spun yarn, the multi-filament yarn also has the function of optical interference. Further, the above fiber of the present invention has the function of optical interference even when used in the form of a short fiber (general short-cut fiber or chopped fiber). The fiber of the present invention is therefore not limited in form so long as its function of optical interference is exhibited.

It has been found that when the fiber having the optical-interference function of the present invention is used for a multi-filament yarn, composite yarn, fibrous structure or non-woven fabric which has a specific structure or form on the basis of its characteristic function of color development and flat cross section, there can be provided textile goods or its intermediate which effectively exhibits the function of optical interference. The application of the fiber of the present invention to various forms will be explained below.

According to the present invention, first, there is provided a multi-filament yarn which is (1) a multi-filament yarn comprising, as a constituent unit, flat optically interfering filaments which are formed by alternately laminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$.

(2) the filaments as a constituent having a flattening ratio in the range of 4.0 to 15.0, (3) the multi-filament yarn having an elongation in the range of 10 to 50%.

For the above multi-filament yarn, it is essential that the flattening ratio of the filaments as a constituent and the elongation of the yarn are brought into the above range, whereby the yarn effectively exhibits the optical interference.

In the fiber having the function of optical interference, generally, the preferred flattening ratio of the fiber is not necessarily in agreement between a mono-filament and a multi-filament yarn. The reason therefor is that the flattening ratio is essential for a mono-filament mainly from the viewpoint of the function of optical interference while it is essential for a multi-filament yarn not only from the above viewpoint but also from the viewpoint of orientation of surfaces of constituent filaments in the major axis direction of the flat cross section. That is, the optically interfering mono-filament has a flat cross-sectional form and has a structure in which polymer layers are alternately laminated in parallel with the major axis direction thereof. Therefore, the optical-interference-functional mono-filament has optical interference characteristics that ① when the filament is viewed perpendicularly to a filament surface formed by its sides in its major axis direction and sides in the lengthwise direction of the filament, the most highest color development based on the optical interference function can be visually recognized, that ② when it is viewed at oblique angles, the effect thereof on the visual recognition sharply decreases, and further, that ③ when it is viewed toward a filament surface formed by its sides in the minor axis direction of the flat cross section and sides in the lengthwise direction of the filament, no optical interference function can be visually recognized.

Nevertheless, when a fabric is formed as a multi-filament yarn from a number of optical-interference-functional mono-filaments having a flat cross-sectional form each, if the flattening ratio is smaller than 4, the mono-filaments are combined together in a form in which they are close-packed in a multi-filament cross section due to a tension and a frictional force working on the filaments. When attention is paid to the filament surface formed by sides in the major axis direction of the flat cross section and sides in the lengthwise direction of the filament therefore, the orientation degree on the above surface of each constituent filament is poor, and the orientation is directed in various directions. As described above, not only the optical interference function inherent to constituent filaments but also the orientation degree of surfaces of the yarn-constituent filaments in the major axis direction of the flat cross section greatly works on the optical interference function of the multi-filament yarn.

Meanwhile, when the above flattening ratio is 4.0 or more, preferably 4.5 or more, particularly preferably 7 or more, a self-orientation control function of each filament constituting the multi-filament starts to work on another filament of the multi-filament, and the constituent filaments are combined so as to bring flat major axis surfaces of the constituent filaments into a direction in parallel with one another, to constitute the multi-filament. That is, when the above multi-filament yarn is pressed and tensioned with a take-up roller or a stretch roller in the step of forming a filament, or when it is taken up around a bobbin in the form of cheese, or when it is pressed on a yarn guide, etc., in the step of weaving a fabric, the filaments are always combined so as to make the flat major axis surface of each filament parallel with the pressing surface each time. Therefore, the parallelism of flat major axis surfaces of the constituent filaments increases, and these filaments as a fabric also come to show a superior optical interference function.

Concerning the upper limit of the flattening ratio, when the value thereof exceeds 15.0, an extremely flat form is produced so that it is difficult to maintain the flat cross section, and part may be folded in the cross section. In view of the above point, the flattening ratio for easy handling is 15 at the most, and it is particularly preferably 10.0 or less.

As described above, the flattening ratio of the constituent filaments is increased to be as large as 4.0 to 15.0 as compared with those of conventional optically interfering filaments, and therefore, the number of the alternately laminated layers is preferably increased as compared with the number of conventional laminated filaments. That is, the number of the laminated layers is preferably at least 15, more preferably at least 20, particularly preferably at least 25.

The above has something to do with a difficulty in forming a filament having a large flattening ratio, i.e., a difficulty in laminating two kinds of molten polymers in a spinneret in the order of 1/10 μm and extruding the polymers through the spinneret as a laminate unit eventually in the order of 1/10 to 1/100 μm to form a fiber. Further, even if the flattening ratio is increased to some extent, it is very difficult to overcome the actions of interfacial tension and Barus effect of polymer flows in the extrusion opening of the spinneret for maintaining the accuracy of alternate lamination in a flat cross section.

According to the optical interference theory, if the thicknesses of all the layers equal standard thickness, an obtained interference light quantity reaches a saturation state when the number of the laminated layers is 10 at the most, and even if the number of the layers is further increased, it only makes the step of filament formation complicated. However, when the flattening ratio is 4.0 or more, the thickness of each layer as a unit of the laminated layers is liable to undergo fluctuation, and when the number of the laminated layer is not 15 or more, the interference light quantity is sometimes deficient. Further, as the flattening ratio is increased to as large as 4.5 and 5.0, it is more preferred to increase the number of the laminated layers, and the number of the laminated layers is preferably 20 or more, more preferably 25 or more.

With an increase in the number of the laminated layers, it is easier to compensate the above fluctuation of the thickness and increase the interference. The number of layers for easy handling is, however, up to 50 in view of difficulties in its production techniques, particularly complicated structure of a spinneret and the control of molten polymer flows. When the number of the laminated layers exceeds it, the fluctuation width of the thickness of the laminated layers is broadened, and it is difficult to obtain an effect measuring up to an increase in the number of the laminated layers. Practically, the limit is 120 layers from the viewpoint of practical use.

As described above, the fiber of the present invention is devised to be able to exhibit the function of excellent optical interference as a multi-filament yarn as well, and further, it is also devised to increase the function of optical interference by considering the birefringence of the fiber in addition to the refractive index inherent to the polymer. That is, with an increase in the refractive index difference between the above polymers, the function of optical interference of the filament increases, while the above increase has its own limit so long as polymers having limited refractive indices are used. For exceeding the above limit to increase refractive index, the birefringence caused by the orientation of fiber molecules is used. By combining a polymer having a high refractive index and having a birefringence which can be increased by drawing with a polymer having a low refractive index and having a birefringence which cannot be much increased by drawing, the refractive index difference between layers of the polymers can be increased. As a means of increasing the above refractive index, the stretch function of the filament is used (with a decrease in the elongation, the birefringence increases on the contrary), and it is required to bring the elongation of a multi-filament yarn after drawing into the range of 10 to 50% in order to satisfy an increase in the birefringence and easy handling in post steps of weaving a fabric or the like. The above elongation is more preferably in the range of 15 to 40%.

The two kinds of polymers for constituting the fiber having the optical-interference function of the present invention are selected in view of combinations of polymers having a difference in refractive indices (n) as described already, more preferably in view of a combination of polymers having solubility parameters (SP values) close to each other, and further more preferably in view of a combination of polymers having chemical affinity to each other.

The above multi-filament yarn having optical-interference function, provided by the present invention, has various appearances in color development depending upon the mode of use, and it can be therefore used in broad use fields. For example, a fabric which uses dense-color, particularly black, filaments as a ground yarn and the multi-filament yarn of the present invention as a float and is patterned with a dobby or jacquard has a classical Japanese gracefulness and is suitable for Japanese clothes, a Japanese clothes belt, a belt fastener, a purse, a cloth wrapper, Japanese sandals (zori), a handbag, a necktie, a drop curtain, etc.

A thin fabric which is obtained by weaving a white ground yarn and the multi-filament yarn of the present invention so as to have a jacquard pattern of the multi-filament yarn has a see-through appearance, and its jacquard pattern has a quality and graceful pearly luster. It is therefore suitable for bridal costumes such as a wedding dress; a party dress; a stage costume; a wrapper for gift articles; a ribbon; a tape; a curtain; and the like.

Further, the gloss color characteristic of the multi-filament yarn can be utilized to give sport wear remarkably excellent in recognizability in the field of conventional sport wear using gloss yarns and fluorescent yarns. For example, the sport wear includes skiwear, tennis wear, a swimming costume, leotards, etc., and it is suitable for a tent, a parasol, a rucksack, and shoes, particularly for sport goods such as sneakers.

Similarly, the object which similarly attracts attention with a gloss color or a pearl-toned color includes arts and crafts such as an emblem, a sticker and art flower, needlework, a wall paper, artificial hair, an automobile sheet and panty hoses.

When a fabric formed of the multi-filament yarn is heat-treated with pressing using a hot emboss roll or a pattern iron, a pressed portion shrinks so that the alternately laminated layers exhibiting interference are overlapped to exhibit a color different from that in the other portion, whereby a one-point mark or a pattern can be provided to clothes.

Further, the above multi-filament yarn can be cut, for example, to a length in the range of 0.01 mm to 10 cm depending upon use. The cut filaments may be fixed to the surface of an article with its flattening surface being front, using a transparent resin. For example, when the cut filaments having the shape of a morpho are fixed to the surface of door of an automobile, they appear blue under the sunlight in the form of a morpho in metallic luster. Further, when a cosmetic containing the multi-filament yarn which has been cut to a length of 0.1 to 0.01 mm is used, it shines gracefully under the sun.

According to the present invention, there is also provided a multi-filament yarn of a type different from the above. This different type is a multi-filament yarn having the optical-interference function of producing different colors which comprises, as a constituent unit, flat optically interfering filaments which are formed by alternately laminating individually independent layers of polymers having different refractive indices in parallel with the major axis direction of the flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$, the filament yarn exhibiting color-developability of different colors along the lengthwise direction thereof and/or among the filaments.

The features of the above multi-filament yarn exhibiting the color-developability of different colors will be explained as some models with reference to FIGS. 3, 4 and 5 hereinafter. FIGS. 3 to 5 are schematic side views of fibers having a flat cross section, provided by the present invention. All the flat cross-sectional structures of the fibers shown in these FIGS. 3 to 5 have the above form shown in FIG. 1 or 2.

FIG. 3 shows a yarn which exhibits interference color development in different colors along the lengthwise direction as a multi-filament yarn. Filament portions T and t constituting the yarn develop colors different from each other, and portions T' and t' exhibit, respectively, colors having wavelengths equal to, or close to, those of colors of the portions T and t. When the yarn as a whole is viewed, a portion P and a portion p show different colors, and portions P' and p' show colors having wavelengths equal to, or close to, those of colors of the portions P and p. In this yarn, therefore, colors are different between the portion P (P') and the portion p (p') as multi bundles. When formed into a fabric, the effect of different colors in the form of streaks is clearly exhibited.

FIG. 4 shows a case where positions of different colors of the filaments constituting the yarn as shown in FIG. 3 are respectively deviated along the lengthwise direction. In this case, therefore, the effect of different colors finely dispersed in the whole is exhibited.

FIG. 5 shows a case where the interference color development exhibits different colors according to different sizes of filaments $f_1$, $f_2$ and $f_3$ constituting the multi-filament yarn. In this case, the yarn as a whole shows a flowing mix of different colors, no color development is entirely uniform along the lengthwise direction, and subtle changes in color are shown depending upon changes in overlaps of constituent filaments. Further, when the yarn is twisted, the Mouliner-like mixed color appearance can be exhibited. Further, when a change in the lengthwise direction in FIGS. 3 or 4 is added to the above yarn of FIG. 5, a far more graceful color can be exhibited.

The different color optically interfering multi-filament yarns of which the side views are shown in FIGS. 3 to 5 can be obtained by producing an undrawn yarn according to the process for the production of the fiber of the present invention and imparting the obtained undrawn yarn with the function of different color optical interference according to the method to be explained below.

First, the method of producing the yarn which exhibits the different color effect of a multi-bundle in the lengthwise direction of the yarn, shown in FIG. 3, will be explained. A multi-filament having an elongation for allowing drawing is spun according to the already explained method of spinning an undrawn yarn. For example, a fiber is spun at a spinning rate of 1,200 m/minute, to obtain a multi-filament yarn having an elongation of about 200%. The yarn is drawn at a temperature which is equivalent to, or lower than, its glass transition temperature and which is lower than a temperature of a spontaneous draw ratio, to obtain a so-called a thick and thin yarn, whereby there is obtained a yarn which exhibits the development of different colors in the lengthwise direction as a multi-bundle. In this case, depending upon the degree of drawing of the thick and thin (dispersion in draw ratio), not only there is obtained a yarn in which two colors are repeated in the lengthwise direction, but also there is obtained a fiber which forms more colors. As another method of producing the yarn shown in FIG. 3, the draw ratio may be changed in the lengthwise direction, for example, by changing the speeds of feed rollers between two pairs of rollers. Further, a once uniformly drawn yarn may be subjected to non-uniform heat shrinkage to locally change the shrinkage factor.

A yarn which has the effect of different colors in constituent filaments and in which the effect is dispersed in the multi-filament yarn as shown in FIG. 4 will be explained below.

The yarn in this case can be produced by utilizing the method of producing the yarn in FIG. 3 and further staggering the drawing initiation point from one constituent filament to another. The method of staggering the drawing point includes a method in which a rod-like yarn guide is disposed immediately after a feed roller to allow adjacent yarns to be dispersed so as not to contact one another or a method in which the feed roller surface is provided with a mat-processed surface and the drawing point is varied in the lengthwise direction and among filaments without providing a press roller used for fixing the drawing point. The yarn of which the constituent filaments have different finesses, shown in FIG. 5, can be produced by changing the polymer amount per extrusion opening among constituents filaments in the already explained spinning of an undrawn yarn. Further, this yarn may be subjected to stretching in FIGS. 3 or 4 without uniformly drawing it in the lengthwise direction, to obtain a yarn which forms colors far more complicatedly.

When the optically interfering multi-filament yarn is imparted with the color-developability in different and multi-colors in the lengthwise direction of the filament yarn and/or among the filaments, there can be obtained a multi-filament yarn having the function of optical interference to exhibit the development of more graceful colors.

According to the present invention, further, there is also provided a multi-filament yarn of a still another type. The yarn of still another type is a multi-filament yarn having-the improved function of optical interference, comprising, as a constituent unit, flat optically interfering filaments which are formed by alternately laminating individually independent layers of polymers having different refractive indices in parallel with the major axis direction of the flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$, the filaments being imparted with an axial twist in the lengthwise direction thereof.

The above multi-filament yarn constituted of filaments imparted with an axial twist in the lengthwise direction characteristically has a so-called angle-following property which permits the observation of optical interference regardless of a viewing angle.

The axial twist refers to a twist in one direction (S or Z direction) caused by twining, alternate twists caused by false twisting, i.e., a state where a twist in S direction and a twist in Z direction are alternately present; alternate twists by air-stuffing, similar to the above alternate twists and a twist caused by mechanically stuff-crimping. Further, the axial twist can be obtained by a covering method. That is, an optically interfering filament in a mono- or multi-filament state is wound around a core yarn, whereby the filament can be imparted with an axial twist. Further, the axial twist can be obtained by interlacing or Taslan processing. In these processings, the filament is exposed to the turbulent flow of a fluid so that the twist is randomly formed along the lengthwise direction of the filament.

The significance of the above axial twist will be discussed. When the optically interfering filament is not axially twisted regardless of a mono- or multi-bundle state, i.e., when it is in a plane state, the development of a color is recognized only at a certain limited angle (angle of incident light), and the above angle is deviated, transparency or white color alone is observed.

In the above multi-filament yarn of the present invention, however, the flat filament is changed from a plane state to a curved surface state by twisting. When the viewing angle changes (the position of the eyes is deviated), therefore, the curved surface state continuously provides a plane which permits the recognition of optical interference corresponding to the "deviation".

The multi-filament yarn constituted by filaments which are axially twisted in the lengthwise direction as described above can be used in broad fields since optical interference can be constantly recognized by virtue of the mode of its use. The fields of use thereof are nearly the same as those of use of the above multi-filament yarn which characteristically have an elongation in the range of 10 to 50%, and the explanation thereof is therefore omitted.

The above multi-filament yarn has various appearances of formed colors depending upon the mode of use, and it can be therefore used in broad application fields. For example, a fabric which uses dense-color, particularly black, filaments as a ground yarn and the multi-filament yarn of the present invention as a float and is patterned with a dobby or jacquard has a classical Japanese gracefulness and is suitable for Japanese clothes, a Japanese clothes belt, a belt fastener, a purse, a cloth wrapper, Japanese sandals (zori), a handbag, a necktie, a drop curtain, etc.

A thin fabric which is obtained by weaving a white ground yarn and the multi-filament yarn of the present invention so as to have a jacquard pattern of the multi-filament yarn has a see-through appearance, and its jacquard pattern has a quality and graceful pearly luster. It is therefore suitable for bridal costumes such as a wedding dress; a party dress; a stage costume; a wrapper for gift articles; a ribbon; a tape; a curtain; and the like.

Further, the gloss color characteristic of the multi-filament yarn of the present invention can be utilized to give sport wear remarkably excellent in recognizability in the field of conventional sport wear using gloss yarns and fluorescent yarns. For example, the sport wear includes skiwear, tennis wear, a swimming costume, leotards, etc., and it is suitable for a tent, a parasol, a rucksack, and shoes, particularly for sport goods such as sneakers.

Similarly, the object which similarly attracts attention with a gloss color or a pearl-toned color includes arts and crafts such as an emblem, a sticker and art flower, needlework, a wall paper, artificial hair, an automobile sheet and panty hoses.

When a fabric formed of the multi-filament yarn of the present invention is heat-treated with pressing using a hot emboss roll or a pattern iron, a pressed portion shrinks so that the alternately laminated layers are overlapped to exhibit a color different from that in the other portion, whereby a one-point mark or a pattern can be provided to clothes.

Further, the above multi-filament yarn can be cut, for example, to a length in the range of 0.01 mm to 10 cm depending upon use. The cut filaments may be fixed to the surface of an article with its flat surface being front, using a transparent resin. For example, when the cut filaments having the form of a morpho are fixed to the surface of door of an automobile, they appear blue under the sunlight in the form of a morpho in metallic luster. Further, when a cosmetic containing the multi-filament yarn which has been cut to a length of 0.1 to 0.01 mm is used, it shines gracefully under the sun.

According to the present invention, further, there is provided a novel textile using a fiber having the function of optical interference. That is, there is provided a float textile having the function of optical interference, the textile containing a texture construction of at least two float components, as a warp and/or a weft, formed of a multi-filament yarn comprising, as a constituent unit, flat optically interfering filaments which are formed by alternately laminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$.

In the above textile of the float texture, the optically interfering multi-filament yarn of the present invention is formed in part or the whole of a texture as a float component, and therefore, the textile has the function of optical interference which exhibits a characteristic color development effect. The above textile of the float texture includes satin, Jacquard, dobby, twill and dice pattern. In the twill, the float texture is selected from the group of 2/2, 3/2 and 2/3.

When a number of optically interfering multi-filament yarns are allowed to be present on the surface of a textile, the float ratio (area ratio) of the optically interfering multi-filament yarns in one entire texture (one repeat) or a float pattern portion of the textile is 60% to 95%, preferably 70% to 90%. When the float ratio exceeds 60%, the color development produced by optical interference is clearly shown. On the other hand, when it exceeds 95%, undesirably, the interlacing frequency of the fibers constituting the textile is extremely low so that the fibers are easily loosened and the strength and the form of the textile can be no longer maintained. When the float ratio is 90% or less, desirably, not only the interlacing of the. fibers can be fully maintained, but also a large number of fibers having the optical-interference function can be arranged on the textile surface.

The float number of textile of the float texture will be explained below. The float number when the fiber is used as a warp refers to how many wefts the warp passes over to interlace with a weft, "the number of wefts over which the warp passes". For example, the float number of the warps is 1 in a 1/1 plain weave fabric, 2 in a 2/2 twill, 3 in a 3/2 twill, or 4 in a 4/1 satin. Further, the float number of the wefts is 3 in a 2/3 twill or 4 in a 1/4 satin texture.

The color development and the optical interference effect (i.e., development of a sharp color having an intense gloss and a color depth) of a texture using the fiber having the optical-interference function as a warp or a weft will be explained mainly on the basis of the above woven textures. When the float number in a woven texture is less than 2, a different color effect is observable only on the basis of a difference from the color of other fiber, while it is only as efficient as that of a chambray fabric. When the float ratio exceeds 60% and the float number is 2 or more, the optical interference effect can be obtained. And, when the float number exceeds 4, the optical interference effect is further increased. The upper limit of the float number is 15 at the most. When it exceeds 15, the interlacing frequency of the fibers constituting the textile is extremely low so that the fibers of the textile easily undergo "loosening" and the strength and the form of the textile can be no longer maintained. When the float number is 10 or less in particular, the strength, the form stability and the high optical interference effect of the textile can be satisfied.

The above-explained optically interfering multi-filament yarn is supplied for weaving while it is in a zero-twisted or twisted state. When the yarn is used as a zero-twisted yarn, filaments are bundled with a sizing agent, and when yarn is used as a twisted yarn, generally, the yarn is twisted not more than 1,000 times/m, particularly not more than 500 times/m. When a zero-twisted yarn is used, the color development effect is produced to the greatest extent theoretically as well. In the twisted yarn, filaments are axially twisted back and forms a color different from that of a zero-twisted yarn. It is therefore useful to use both the yarns as required or to use yarns having different twisting numbers depending upon a purpose.

In other embodiment, desirably, a densely colored fiber is used as a textile-constituting fiber other than a float component as measures to remove stray light in the above float textile. In this case, the color development effect produced by using mono-filaments having a flattening ratio of 4 or more as units for constituting the multi-filament yarn is fully supported.

The above point will be explained. The optically interfering filament forms a color on the basis of the interference of incident light and reflected light. Meanwhile, human eyes recognize the intensity of a color on the basis of a difference between interference light and stray light which is reflected from other site into the eyes. When stray light from around is intense, interference light cannot be recognized as a color even if the interference light is sufficient. As a means of preventing the stray light, it is preferred to use a fiber having the function of absorbing light from around, particularly stray light, as a weft or a warp which is the closest to the optically interfering filament and intertwined with the optically interfering filament. For absorbing stray light, it is preferred to use a fiber dyed in a dense color and/or a spun dyed fiber. Black is particularly preferred since it absorbs all of rays and has a high effect on the removal of stray light. It is further preferred to use a densely colored fiber having a hue having a complementary color relationship with the formed color of the fiber having the optical-interference function as a weft or a warp which is intertwined with the fiber having the optical-interference function. The fiber colored in a hue having a complementary color relationship with interference light not only absorbs light of the complementary color but also reflects light having a wavelength around that of the interference light. That is, a textile of the above texture has advantages in that it can use interference light and that light of stray light which has a wavelength around that of the interference light, as reflected light, so that the intensity of the reflected light is increased, and that a difference from stray light from other portion can be produced to a great extent.

The size (denier) of the mono-filament and the size (denier) of the multi-filament yarn can be properly determined by taking account of the feeling and the performance of an intended textile. Generally, the former is in the range of 2 to 30 denier, and the latter is in the range of 50 to 300 denier.

In the present invention, the problem why the optical interference effect of a multi-filament yarn formed of mono-filaments having the excellent function of optical interference itself is impaired and the analysis of its cause have made the starting point of the present invention, and it has been found that the above problem is caused by the direction-dependency of the color development of the optically interfering filaments and the filament assembly state of the multi-filament yarn. That is, the optically interfering mono-filament has a flat cross section and has a structure in which polymers are alternately laminated in parallel with the major axis thereof. Therefore, when the optically interfering mono-filament is viewed perpendicularly toward a filament surface formed by sides thereof in the major axis direction and sides thereof in the filament lengthwise direction, a color formed by the optical interference is the most intensely recognized, and when it is viewed at oblique angles, the effect thereof on the visual recognition sharply decreases. In contrast, when it is viewed toward a filament surface formed by sides in the minor axis direction of the flat cross section and its sides in the filament lengthwise direction, no optical interference function can be visually recognized.

According to the present invention, there is provided a novel embroidery fabric using the above fiber having the optical-interference function of the present invention. That is, the present invention provides an embroidery fabric prepared by embroidering a substrate cloth with a multi-filament yarn, as an embroidery yarn, comprising, as a constituent unit, flat optically interfering filaments which are formed by alternately-aminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$, the stacking number of the filaments constituting the embroidery yarn stacked in the direction intersecting at right angles with the substrate cloth being 2 to 80.

A fabric in which the fiber, particularly multi-filament yarn, having the optical-interference function provided by the present invention, particularly the multi-filament yarn of the present invention, is arranged has a clear hue which is characteristic, aesthetic, graceful and clear based on the optical interference.

In the above embroidery fabric, the above optically interfering filament alone or an embroidery yarn formed of it as a constituent unit is arranged on a substrate cloth. The essential point in this case is that the stacking number of the filaments is to be maintained to be 2 to 80, preferably 2 to 50.

The above point will be explained in detail with reference to FIG. 6. FIG. 6 is a schematic cross-sectional view of an embroidery portion of an embroidery fabric in which the optically interfering filaments are arranged as an embroidery yarn, S indicates a substrate cloth, E indicates an embroidery portion, and M indicates the optically interfering filament (mono-filament) arranged as an embroidery yarn. The above stacking number of the optically interfering filaments means the number of filaments present on each of random vertical lines $L_1$, $L_2$, $L_3$ and $L_4$, as shown in the figure. The above stacking number (n) of the filaments along line $L_1$ is 4, and similarly, n=5 on $L_2$, n=6 on $L_3$ and n=3 on $L_4$. When the above stacking number n exceeds 80, almost no interference color from the embroidery portion is recognized and a mere whitish gloss is recognized, so that it is utterly meaningless to arrange the optically interfering filaments as an embroidery yarn. In contrast, when n is 5 to 50 in particular, the interference effect of the filaments is exhibited sufficiently enough. In this case, other colored filaments may be used in combination with these filaments for putting the accent on the force of interference. In an actual embroidery fabric, an embroidery yarn goes through up to the reverse surface of the substrate fabric (portion below the substrate fabric in Figure), while FIG. 6 omits it for simplification.

In the present invention, it is preferred to use the optically interfering filaments having a flattening ratio of 4 to 15 as an embroidery yarn using a multi-filament comprising 2 to 80 filaments for producing the maximum optical interference effect thereof.

The above flattening ratio refers to a value of a ratio W/T in which W is a length of major axis of the flat cross section and T is a length of the minor axis thereof, as already described. A flattening ratio of as large as 3.5 is sufficient for attaining the function of optical interference as a mono-filament as is conventionally proposed with regard to the flattening ratio. When a plurality of such mono-filaments are combined and used as a multi-filament yarn, however, flat major-axis surfaces of the mono-filaments are arranged at random and bundled, and a multi-filament as a whole can no longer effectively exhibit the function of optical interference.

However, when the flattening ratio is a value of 4 or more, preferably 4.5 or more, each filament to constitute the multi-filament yarn is imparted with the function of self-direction-dependency control, and the filaments are bundled and formed into a multi-filament yarn such that the flat major axis surfaces of the constituent filaments are in parallel with one another. That is, when the above filaments are pressed and tensioned with a take-up roller or a stretch roller in the step of forming the filaments or when they are taken up around a bobbin in the form of cheese, or the yarn is pressed on a yarn guide, etc., in the step of weaving a fabric, the filaments are always combined so as to make the flat major axis surface of each filament parallel with the pressing surface each time. Therefore, the parallelism of flat major axis surfaces of the constituent filaments increases, and the fabric comes to show a superior optical interference function.

Further, the multi-filament yarn to be arranged for the above embroidery fabric has an elongation in the range of 10 to 60%, preferably 20 to 40%. That is because the multi-filament which has been spun and once cooled to solidification is drawn to increase its birefringence ($\Delta n$), so that the refractive index difference as "refractive index of polymer plus birefringence of fiber" between polymers is consequently increased as a whole, whereby the function of optical interference is increased.

When the above-explained optically interfering filaments are bundled into a multi-filament yarn, they are used in a zero-twisted or twisted state. When the filaments are used as zero-twisted filaments, filaments are bundled with a sizing agent, and when they are used as twisted filaments, generally, they are twisted not more than 1,000 times/m, particularly not more than 500 times/m. When the zero-twisted filaments are used, the color development effect is produced to the greatest extent theoretically as well. In the twisted filaments, filaments are axially twisted back and form a color different from that of the zero-twisted filaments. It is therefore useful to use both of them as required or to use yarns having different twisting numbers depending upon a purpose.

In other embodiment of the embroidery fabric, desirably, it is preferred to constitute the substrate fabric of a fiber densely dyed at an L value of not more than 40, preferably not more than 25 or a spun dyed fiber as measures to remove stray light in the embroidery fabric. In this case, the color development effect produced by using mono-filaments having a flattening ratio of 4 or more as units for constituting the multi-filament yarn is fully supported.

L value can be directly obtained with a color-difference meter, and in the present invention, there is used a color-difference meter, type ND-101DC manufactured by Nippon Denshoku Kogyo Co., Ltd., to measure L values.

An optically interfering filament forms a color on the basis of interference of incident light and reflected light. Meanwhile, human eyes recognize the intensity of a color on the basis of a difference between interference light and stray light which is reflected from other site into the eyes. When stray light from around is intense, therefore, interference light cannot be recognized as a color even if the interference light is sufficient. As a means of preventing the stray light, it is preferred to use a fiber having the function of absorbing light from around, particularly stray light, as a weft or a warp which is the closest to the optically interfering filament and intertwined with the optically interfering filament. For absorbing stray light, it is preferred to use a fiber dyed in a dense color and/or a spun dyed fiber. Black is particularly preferred since it absorbs all of rays and has a high effect on the removal of stray light. It is further preferred to use a densely colored fiber having a hue having a complementary color relationship with the formed color of the optically interfering fiber, as a weft or a warp which is intertwined with the optically interfering fiber. The fiber colored in a hue having a complementary color relationship with interference light not only absorbs light of the complementary color but also reflects light having a wavelength around that of the interference light. That is, a textile of the above texture has advantages in that it can use interference light and that light of stray light which has a wavelength around that of the interference light, as reflected light, so that the intensity of the reflected light is increased, and that a difference from stray light from other portion can be produced to a great extent.

The above embroidery fabric of the present invention uses the optically interfering filament as an embroidery yarn, and can therefore provide an embroidery article having a gracefulness entirely different from a dyed embroidery yarn.

According to the present invention, further, there is provided a novel composite yarn using the fiber having the optical-interference function of the present invention and having a characteristic optical function.

That is, according to the present invention, there is provided a composite yarn comprised of a high-shrinkable yarn and a low-shrinkable yarn, the low-shrinkable yarn being mainly comprised of optically interfering filaments which are formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1{,}2$.

In the above composite yarn, a multi-filament yarn comprised of the already described optically interfering filaments as constituent units is compounded with a multi-filament yarn having a higher shrinkage percentage in boiling water than the former yarn, to form a composite yarn. The color developability of the optically interfering mono-filaments and the arrangement of the filaments have a highly close relationship, and with an increase of the number of the optically interfering filaments present on the yarn surface, higher color development is obtained. In this sense, the optically interfering multi-filament yarn is arranged in the composite yarn of the present invention as that low-shrinkable component of a shrink-different mixed yarn which imparts the yarn with the appearance of swelling and softness.

An optically interfering filament forms a color on the basis of interference of incident light and reflected light. Meanwhile, human eyes recognize the intensity of a color on the basis of a difference between interference light and stray light which is reflected from other site into the eyes. When stray light from around is intense, therefore, interference light cannot be recognized as a color even if the interference light is sufficient. As a means of preventing the stray light, it is preferred to use a multi-filament yarn having the function of absorbing light from around, particularly stray light, as a high-shrinkable multi-filament yarn which is the closest to the optically interfering filament. For absorbing stray light, it is preferred to use a dyed fiber or a spun dyed fiber having an L value of 40 or less, preferably 30 or less, more preferably 20 or less. A multi-filament yarn in black is particularly preferred since it absorbs all of rays and has a high effect on the removal of stray light. It is further preferred to use a multi-filament yarn having a hue having a complementary color relationship with the formed color of the optically interfering filament as a high-shrinkable component. That is because the composite yarn can use, as reflected light, interference light and light having a wavelength around that of the interference light so that the intensity of the reflected light is further increased and that the color development based on the interference can be attained to a great extent.

Embodiments of the composite yarn in the present invention include a mixed yarn, a braid, a covered yarn. In the covered yarn, naturally, the optically interfering multi-filament yarn is twined around the high-shrinkable multi-filament yarn.

When the above composite yarn in the state of a yarn or a fabric is subjected to heat treatment for shrinkage, the high-shrinkable multi-filament yarn is further shrunk to be sunken into the inside (core portion) of the composite fiber and the optically interfering multi-filament yarn is floated on the surface (sheath portion) of the composite yarn, whereby an optical interference effect can be attained to a great extent.

For the above floating up of a group of the optically interfering multi-filament yarns through the heat-shrinking treatment in the composite yarn of the low-shrinkable optically interfering multi-filament yarn and the high-shrinkable multi-filament yarn, the shrinkage percentages BWS thereof in boiling water preferably satisfy the following expressions.

$$BWS(A) \leqq 20\% \quad (1)$$

$$BWS(B) - BWS(A) \geqq 5\% \quad (2)$$

$$BWS(B) \leqq 30\% \quad (3)$$

The shrinkage percentage BWS(A) of the low-shrinkable optically interfering multi-filament yarn is preferably not more than 20% as shown in the expression (1). When the shrinkage percentage BWS(A) exceeds 20%, it is not possible to attain no sufficient shrinkage percentage difference from the multi-filament yarn as the other multi-filament yarn to be intertwined. The shrinkage percentage BWS(A) of not more than 10% is particularly preferable. On the other hand, the shrinkage percentage BWS(B) of the high-shrinkable multi-filament yarn is preferably not more than 30%. When the shrinkage percentage BWS(B) exceeds 30%, a change in dimensions is too large during the shrinking treatment so that it is difficult to obtain an intended product. Further, the value of BWS(B) is preferably not more than 25%.

Further, the value of [BWS(B)−BWS(A)] is preferably 5% or more. When the above value is less than 5%, the optically interfering multi-filament yarn cannot be allowed to float up on the surface of a fabric or a braid. Further, the shrinkage percentage difference in boiling water is preferably 7% or more, more preferably 9% or more.

In the composite yarn of the present invention, it is preferred to use the mono-filament having a flattening ratio of 4 to 15, preferably 4.5 to 10, for producing the optical interference effect of the optically interfering multi-filament yarn as a whole to the greatest extent.

In the optically interfering multi-filament yarn used in the composite yarn of the present invention, desirably, the elongation thereof is in the range of 10 to 60%, preferably in the range of 20 to 40%. It is because the multi-filament yarn which is spun and cooled to solidification is drawn to increase its birefringence (Δn) so that the refractive index difference as "refractive index of polymer plus birefringence of fiber" between polymers is consequently increased as a whole, whereby the function of optical interference is increased.

According to the composite yarn of the present invention, the optically interfering multi-filament yarn and the yarn having a higher shrinkage percentage in boiling water than the above yarn form a composite structure where they are co-present, and there are therefore the following advantages.

a. When the composite yarn is heat-treated for shrinkage, the high-shrinkable yarn is sunken into the composite yarn (i.e., to be positioned in a core portion), and the other optically interfering multi-filament yarn is floated up on the surface of the composite yarn, to form a structure where it covers the composite yarn surface, finally the surface of a fabric.

b. In this case, the two yarns have a difference in yarn length so that the composite yarn shows an appearance of swelling and softness and attains a desired feeling. At the same time, since the composite yarn surface is covered with the optically interfering multi-filament yarn, the optical interference is more strengthened to give a clear color development effect.

c. As for these effects, a conventional method, i.e., a union fabric of optically interfering mono-filaments and other fiber brings a parallel state where these two yarns are necessarily present side by side, and hence, there is no case where optically interfering multi-filament yarns are present on the entirety of the textile surface. The optical interference effect on the fabric surface is low as compared with the composite yarn of the present invention, and at the same time, in view of the fact that neither the appearance of swelling nor the appearance of softness has not been realized on the fabric, the significance of the present invention is made clear.

According to the present invention, further, there is provided a differently brightening non-woven fabric using the above fiber having the optical-interference function of the present invention. That is, according to the present invention, there is provided a differently brightening non-woven fabric obtained by randomly and collectively stacking flat optically interfering filaments in a state where the filaments are axially twisted at intervals along the major axis thereof, the filaments being formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$.

In a preferred embodiment of the present invention, the above non-woven fabric is compounded with one surface or both surfaces of a substrate formed of a fiber colored or dyed with a dense color, particularly, at an L value of not more than 40, preferably not more than 30, more preferably not more than 20 or a spun dyed or dyed fiber, whereby the color depth, the clearness and the gloss thereof are further emphasized.

In the optically interfering filament used in the non-woven fabric of the present invention, it is particularly preferred as the form of a cross section to have a large flattening ratio since a large area effective for optical interference can be provided. The flattening ratio of the flat fiber is preferably at least 4 and not more than 15.

In the production of a non-woven fabric from the optically interfering filaments having the above flat cross section, when the filaments are stacked in parallel with one another, not only the probability of incident light reaching the bottom portion of a stacked product decreases, but also the color development intensity decreases due to the reflection of stray light from each filament, and hence, the non-woven fabric cannot be provided for practical use. The essential point of the present invention is that the optically interfering filaments are randomly and collectively stacked in a state where they are axially twisted at intervals along the major axis thereof.

Further, the fiber having the optical-interference function is collectively stacked on one surface or both surfaces of a substrate cloth formed of a fiber colored in a dense color, whereby an intense color development effect can be obtained. Surprisingly, further, it has been found that a formed color from the non-woven fabric is observable without depending upon a viewing angle. The reason why the formed color is not observed when the fibers having the optical-interference function are overlapped has not yet been fully clarified, while it is caused presumably for the following reason.

The optically interfering filament has a structure in which layers of two polymers are laminated, while the filament per se is transparent. Part of incident light is reflected, and the part and light having a wavelength congruent with interference conditions strengthen their intensity to form an interference color. Meanwhile, since the optically interfering filament is originally transparent, part of incident light passes through the filament. The light which has passed comes into an optically interfering filament located below, and part of it becomes interference light and other part becomes mere reflected light or transmitting light. Even if filaments having an optical interference effect are present, filaments which are present merely in irregular positions reflect rays having various wavelengths. Meanwhile, human eyes recognize an intensity of a color on the basis of a difference between interference light and stray light which is reflected from other site to come into the human eyes. When stray light from around is intense, therefore, interference light cannot be recognized as a color even if the interference light is sufficiently present. This is a great difference between the color development caused by light absorption and the color development caused by reflection.

On the other hand, of fiber stacked products such as a non-woven fabric, one which is partly axially twisted shows a high interference effect, i.e., high color development. Meanwhile, stray light from the bottom of the stacked product decreases the interference effect, but this defect can be overcome by incorporating a non-woven fabric into the surface of a fiber substrate cloth having a stray light absorption effect.

For removing stray light, it is preferred to use, as a substrate, a fiber dyed in a dense color with a dye or a fiber colored in a dense color with a pigment, particularly dyed at an L value of not more than 40. Black is particularly preferred since it absorbs all of rays and has the greatest effect of removing stray light.

Further, it is preferred to use a fiber (substrate) colored in a dense color having a hue having a complementary color relationship with the formed color of the optically interfering filament in the center or on one surface of the non-woven fabric. The fiber colored in a hue complementary to interference light not only absorbs light of the complementary color but also reflects light having a wavelength around that of the interference light. That is, the interference light and the light having the same wavelength as that of interference light in stray light portion can be used as reflected light, so that a difference from stray light from other portion can be produced to a great extent and that the intensity of the color development is increased.

The production of the non-woven fabric can be easily carried out by a known direct fabrication method or a card web method. In the former method, polymer flows extruded through a group of spinnerets are cooled to solidification, and when they are guided and led from an extruder to/against a collector surface, each fiber is axially twisted and at the same time a group of the fibers are randomly collectively stacked. In the other card web method, each fiber is axially twisted in advance by crimping by employing a mechanical crimping method such as stuff-crimping or air-stuffing method and then formed into staple fibers, and therefore, the fibers are formed into a non-woven fabric according to a known card web method.

The essential point is that the optically interfering filaments constituting the non-woven fabric are axially twisted at intervals along their major axis direction. In a non-woven fabric prepared by collectively stacking fibers without axially twisting them, the non-woven fabric merely appears transparent or white, and no color development based on optical interference can be obtained. Further, it has been also found that a sandwich structure formed of the non-woven fabrics of the optically interfering filaments and a colored substrate cloth gives a further color development effect. When such a structure is employed, the color development is observed at any angle.

According to the differently brightening non-woven fabric, there is provided a non-woven fabric which performs graceful color development which is not at all observed in any conventional non-woven fabric. Although it is a non-woven fabric, therefore, it makes a clean sweep of the image of conventional non-woven fabrics and can be advantageously used for a ribbon, a tape, a curtain, arts and crafts such as an emblem, a sticker and art flower, needlework, a wall paper, and artificial hair.

According to the present invention, further, there is provided a novel and improved optical-interference-functional fibrous structure using the above optical-interference-functional fiber of the present invention. That is, according to the present invention, there is provided a fibrous structure having a novel and improved function of optical-interference, which contains flat optically interfering filaments which are formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.2$, and a coating layer of a polymer is formed on at least the surface of the optically interfering filaments, a refractive index of the polymer being lower than the refractive index of a polymer which constitutes the optically interfering filaments and has a highest refractive index.

In the present invention, a solution containing a low refractive index polymer is applied to a fibrous structure constituted by the above optically interfering filaments as a constituent unit, e.g., a fibrous structure containing a multi-filament yarn, to form a coating of the above polymer on the surface of the filaments. The essential point in this case is to decrease surface reflection light, while it is the most essential to allow the multi-filament yarn as a whole to exhibit the optical interference effect up to a maximum. For this reason, filaments having a flattening ratio of 4 to 15 are used as the filaments.

The elongation of the optically interfering filament of the present invention is in the range of 10 to 60%, preferably 20 to 40%. That is because the multi-filament yarn which is spun and cooled to solidification is drawn to increase its birefringence ($\Delta n$) so that the refractive index difference as "refractive index of polymer plus birefringence of fiber" between polymers is consequently increased as a whole, whereby the function of optical interference is increased.

The fibrous structure referred to in the present invention means tow, a multi-filament yarn, a textile, a knitting, non-woven fabric, a paper-like material and the like. A low refractive index polymer in the form of an emulsion in an organic solvent or an aqueous emulsion is applied to the above structure. The application method, i.e., the method of coating, can be any method selected from a padding method, a spraying method, a kiss roll method, a knife coating method and an adsorption-in-bath method.

Meanwhile, of the two polymers constituting the optically interfering filament, the high refractive index polymer generally has a refractive index of 1.49 to 1.88. It is therefore preferred to properly select a polymer having a refractive index in the range of 1.35 to 1.55 as a low refractive index polymer for forming the coating.

Examples of the above low refractive index polymer include fluorine-containing polymers such as polytetrafluoroethylene, a tetrafluoroethylene-propylene copolymer, a tetrafluoroethylene-hexafluoropropylene copolymer, a tetrafuloroethylene-ethylene copolymer, a tetrafluoroethylene-tetrafluoropropylene copolymer, polyfluorovinylidene, polypentadecafluorooctyl acrylate, polyfluoroethyl acrylate, polytrifluoroisopropyl methacrylate, polytrifluoroisopropyl methacrylate and polytrifluoroethyl methacrylate; silicon-containing compounds such as polydimethylsilane, polymethylhydrodiethylenesiloxane and polydimethylsiloxane; acrylate esters such as polyethyl acrylate and polyethyl methacrylate; a polyurethane polymer; and the like.

In other embodiment of the fibrous structure of the present invention, when the fibrous structure uses a fiber of other kind in combination, the fiber of other kind is preferably colored in a dense color. In this case, the color development effect based on the use of the optically interfering monofilament having a flattening ratio of 4 or more as a unit of the multi-filament yarn is fully exhibited.

The above point will be discussed. The optically interfering filament forms a color on the basis of interference of incident light and reflected light. Meanwhile, human eyes recognize the intensity of a color on the basis of a difference between interference light and stray light which is reflected from other site into the eyes. When stray light from around is intense, therefore, interference light cannot be recognized as a color even if the interference light is sufficient. As a means of preventing the stray light, it is preferred to use a fiber having the function of absorbing stray light, as a fiber of other kind which is the closest to the optically interfering filament. For absorbing stray light, it is preferred to use a dyed fiber or a spun dyed fiber having an L value of not more than 40. Black is particularly preferred since it absorbs all of rays so that it a high effect on the removal of stray light. It is further preferred to use a densely colored fiber having a hue having a complementary color relationship with the formed color of the optically interfering filament. The fiber colored in a hue having a complementary color relationship with interference light absorbs light of a complementary color and at the same time reflects light having a wavelength around that of the optical interference light. That is, the above texture can use, as reflected light, interference light and light having a wavelength around that of the interference light in a stray light portion so that the intensity of the reflected light is further increased and that a greater difference from stray light from other portion can be advantageously attained.

In the fibrous structure according to the present invention, the decrease in the light reflected on the surface of the optically interfering filaments by a coating of the low refractive index polymer is nothing but an auxiliary one as far as the optical interference is concerned. The point is that the fibrous structure is based on how to improve the interference effect of the optically interfering filaments in a fibrous-structure state. That is, it has been studied what inhibits the optical interference effect of filaments having excellent optical interference function themselves when they are in a fibrous-structure state such as a multi-filament yarn, and as a result, the cause has been found in the direction-dependency of color development of the optically interfering filaments and the filament collected structure of the multi-filament yarn. That is, the optically interfering filament has a flat cross section and has a structure in which polymers are alternately laminated in parallel with the major axis direction thereof. It therefore has optical interference characteristics that when the filament is viewed perpendicularly to a filament surface formed by its sides in its major axis direction and sides in the lengthwise direction of the filament, the most highest color development based on the optical interference function can be visually recognized, that when it is viewed at oblique angles, the effect thereof on the visual recognition sharply decreases, and in contrast, that when it is viewed toward a filament surface formed by sides in the minor axis direction of the flat cross section and its sides in the lengthwise direction of the filament, no optical interference function can be visually recognized.

On the other hand, when the optically interfering filaments having a flat cross section are collected to form a fabric of a multi-filament yarn, the filaments are gathered together in a form in which they are close-packed in the cross section of a multi-filament yarn due to a tension and a friction force working on the filaments. When attention is paid to the filament surface formed by sides in the major axis direction of the flat cross section and sides in the lengthwise direction of the filament to study the parallelism of the above surfaces of the constituent filaments, the orientation degree on the above surface of each constituent filament is poor, and the orientation is directed in various directions.

On the basis of the above-explained recognition of the problem and the above-explained analysis of its cause, it is the requirement of flattening ratio of at least 4 that imparts the filaments which constitute the multi-filament yarn with the self-direction-dependency control function that the filaments can constitute the multi-filament yarn by collecting their flat surfaces so as to make them in parallel with one another. At the same time, according to the present invention, not only these flat yarns have a flat surface so that they have excellent abrasion resistance and exhibits a permanent interference function, but also there is no possibility of spots being formed by the adherence of a low refractive index polymer so that light reflected on the surface is decreased by a uniform coating of the polymer. As a result, a high-degree interference color can be obtained.

The present invention enables the multi-filament yarn formed of the optically interfering filaments to exhibit effects similar to those of the optically interfering filaments, and there is also produced an effect that light reflected on the surface is decreased by the coating of the low refractive index polymer. There can be therefore materialized the fibrous structure which can satisfy both a feeling and a color development.

E is an embroidery portion, M is an optically interfering fiber and S is a substrate cloth.

Figure 7:
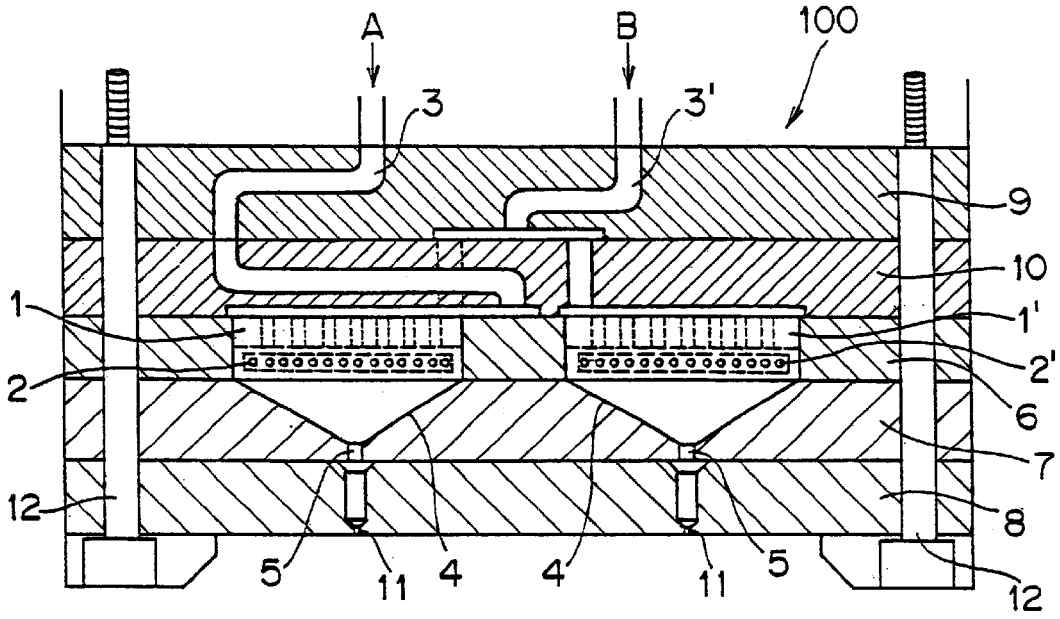

FIG. 7 is a cross-sectional elevation of one example of the spinneret used for the production of the fiber of the present invention.

Figure 8:
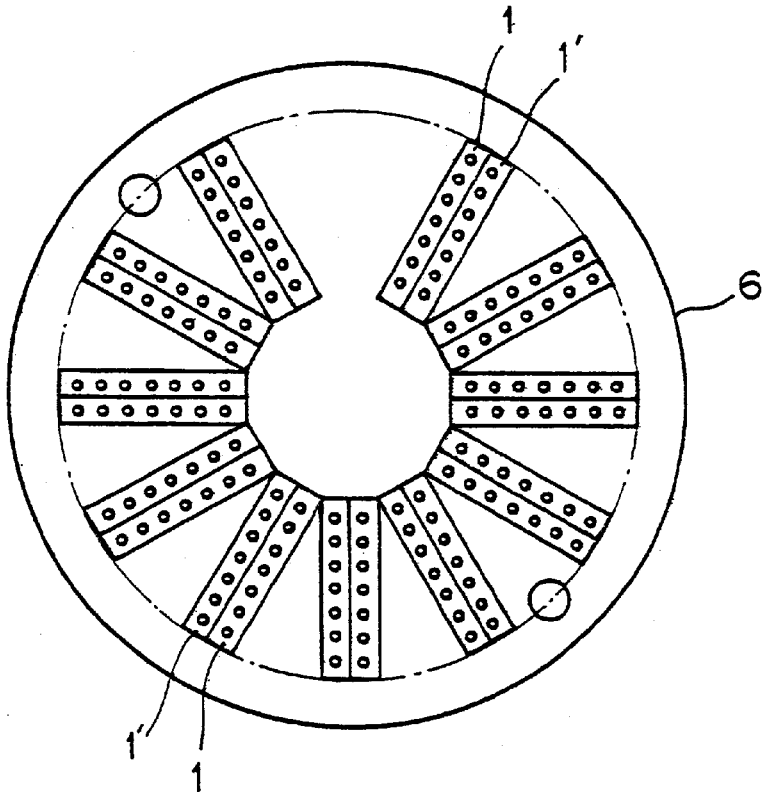
Figure 8:
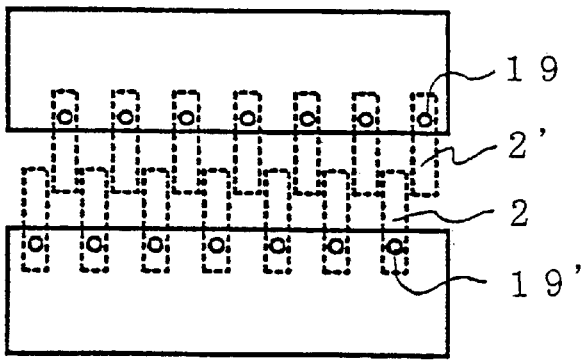

FIG. 8(*a*) is cross-sectional plan view of an upper spinneret member 6 of the spinneret of FIG. 7 when it is viewed from above.

(*b*) is an enlarged view of nozzle plates 1, 1' in the spinnert of FIG. 7.

A Symbols in FIGS. 7 and 8 indicate the following.

A Polymer layer

B Polymer layer

1 Nozzle plate

1' Nozzle plate

2 Opening made in nozzle plate

2' Opening made in nozzle plate

3 Introducing line

3' Introducing line

4 Funnel-shaped portion

5 Final extrusion opening

6 Upper spinneret member

7 Middle spinneret member

8 Lower spinneret member

9 Upper distributor

10 Lower distributor

11 Final spinning outlet

12 Bolt

19 Supply line

19' Supply line

Figure 9:
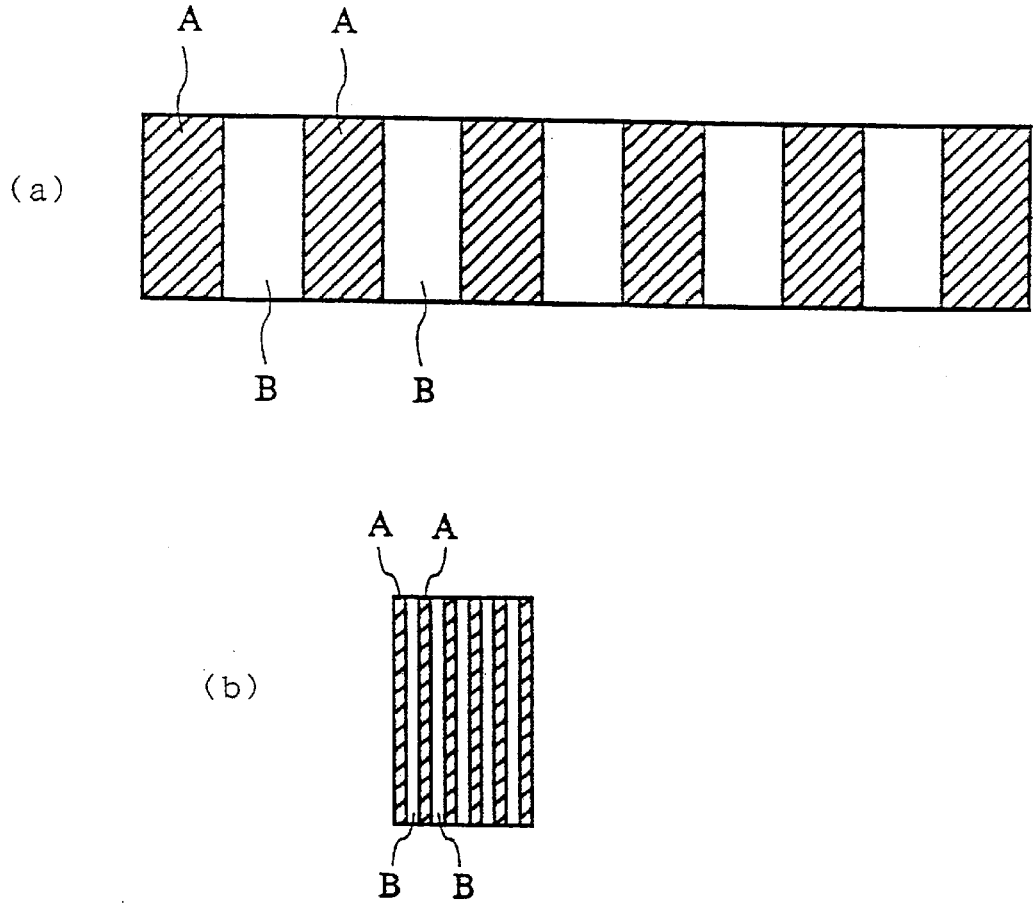

FIG. 9(*a*) is a schematic cross-sectional view of extrusion of laminated polymer flows of polymer A and polymer B through a pair of nozzle plates 1 and 1'.

(*b*) is a schematic cross-sectional view of final n of the above laminated polymer flows through extrusion opening 11.

Figure 10:
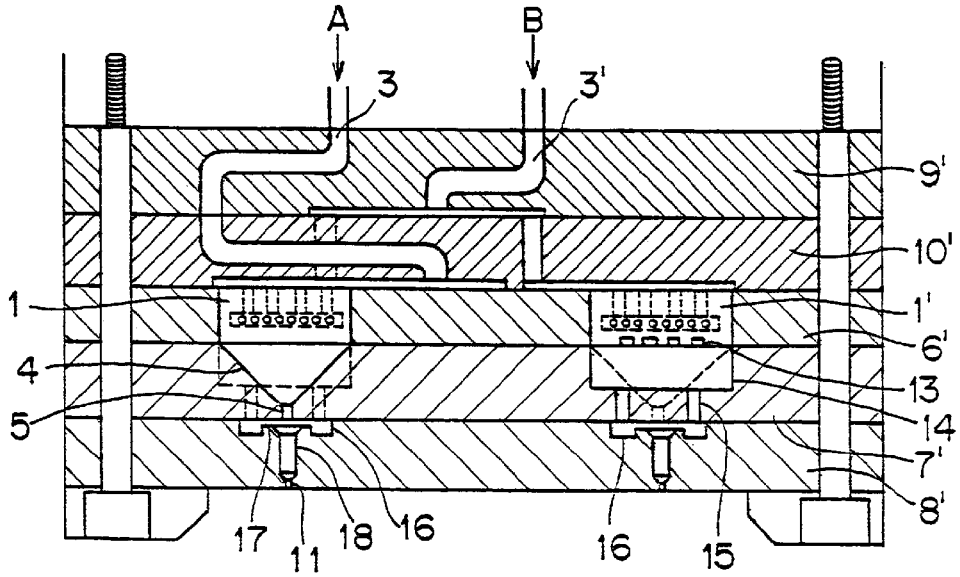

FIG. 10 shows a partial vertical cross-sectional view of one example of the spinneret used for forming a protective layer on the circumferential portion of an alternate laminate portion in the flat cross section of the fiber.

Symbols excluding the following numbers mean the same as those in FIGS. 7 and 8.

13 Flow path of reinforcing polymer

14 Flow path of reinforcing polymer

15 Flow path of reinforcing polymer

16 Flow path of reinforcing polymer

17 Flow Path of reinforcing polymer

18 Flow path of reinforcing polymer

EXAMPLES

In Examples, solubility parameter values (SP values) of polymers, flattening ratios and color developability were measured by the following methods.

(1) SP Value and SP Ratio

An SP value is a value expressed by a square root of a cohesive energy density (Ec). The Ec of a polymer is determined by immersing the polymer in various solvents to find a solvent in which a swelling pressure is maximum and taking an Ec of the solvent as an Ec of the polymer. SP values of polymers obtained as above are described in "PROPERTIES OF POLYMERS" 3rd Edition (ELSEVIER), p.792. When the Ec of a polymer is unknown, it can be calculated on the basis of the chemical structure of the polymer. That is, the Ec can be determined as a total sum of Ec's of substituents constituting the polymer. The Ec's of substituents are described in the above literature, p.192. According to this method, an SP value can be determined e.g., with regard to a copolymerized polymer. The SP ratio can be determined as follows.

$$SP\ ratio = \frac{SP\ value\ of\ high\ refractive\ index\ polymer\ (SP_1)}{SP\ value\ of\ low\ refractive\ index\ polymer\ (SP_2)}$$

(2) Flattening Ratio

The cross section of a fiber is observed through an electron microscope, and the flattening ratio is determined on the basis of a ratio of a length in parallel with a laminated surface (major axis) and a length perpendicular to the laminated surface (minor axis). The flattening ratio is expressed by a ratio of the above major axis/the above minor axis.

(3) Interference Effect

Fifty multi-filament yarns were arranged on a black plate in parallel with one another without any interval under a constant light quantity indoors, and the color development thereof was visually observed.

Examples A-1~A-6

Polyethylene-2,6-naphthalate (n=1.63, SP value=21.5 (calculated value)) copolymerized with 1.5 mol % of sodium isophthalate for improving the compatibility of both the polymers and nylon 6 (n=1.58, SP value=22.5) (SP ratio= 0.96) were melt-spun through spinnerets shown in FIG. 10, and a yarn was taken up at a rate of 1,200 m/minute. In this case, the opening diameters of opening portions on both ends of the opening portions shown in the nozzle plates 1 and 1' were changed to form-a cross-sectional shape shown in FIG. 2, whereby an undrawn yarn having an alternate laminate portion and a protective layer portion was obtained. Then, the undrawn yarn was drawn at a draw ratio of 2.0 with a roller-type drawing machine according to a conventional method, to give a drawn yarn of 11 filaments.

The obtained filaments were evaluated for reflection spectrum at an incidence angle of 0 degree/light receiving angle of 0 degree with a microscope spectrometer (model U-6000: Hitachi Limited). In the reflection spectrum of each of the obtained filaments, a half-width of light formation peak wavelength (wavelength width where the light-emission intensity became half) was determined. Further, the cross section of the fiber was observed through an electron microscope, and each layer and the protective layer were measured for thickness. Table 1 shows the results.

TABLE 1

| | Thickness of protective layer portion (μm) | Average thickness of layers of alternate laminate portion (μm) | Half-width (nm) | Color developability |
|---|---|---|---|---|
| Example A-1 | 5.8 | 0.012 | 88 | Developing intense green color |
| Example A-2 | 7.2 | 0.011 | 89 | " |
| Example A-3 | 7.8 | 0.013 | 106 | Developing intense greenish yellow color |
| Example A-4 | 6.2 | 0.014 | 115 | " |
| Example A-5 | 5.8 | 0.016 | 135 | Developing orange color |
| Example A-6 | 3.9 | 0.017 | 156 | Developing red color |

Examples B-1~B-6 and Comparative Examples B-1~B-5

1.0 Mole of dimethyl terephthalate, 2.5 mol of ethylene glycol and various amounts of sodium salt of sulfoisophthalic acid were added, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant copolyester (PET copolymer) had an intrinsic viscosity in the range of 0.47 to 0.50.

Further, as polymethyl methacrylate (PMMA), polymers having various acid values and a melt flow rate, at 230° C., of 9 to 20 were used.

Figure 1:
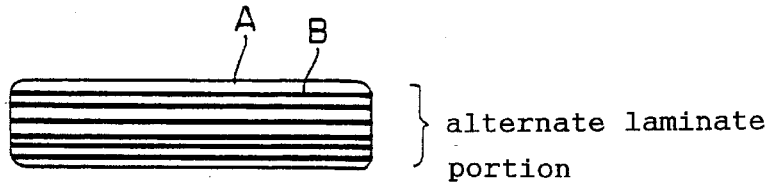
FIG. 1 is a schematic cross-sectional view of a fiber having the optical-interference function of the present invention.

The PET copolymer/PMMA=1/1 (weight) were co-spun at a rate of 2,000 m/minute so as to form a 15-layered composite form having a flat cross section shown in FIG. 1. This as-spun yarn was drawn to 1.5 times with a roller-type drawing machine to give a drawn yarn having 85 denier/24 filaments. An electron microscopic photograph of cross section of this flat yarn was taken, and a PET layer and a PMMA layer were measured for a thickness in a central point and a thickness in point located ⅛ of the length of major axis far from end thereof, to determine average values.

The PET copolymer had an SP value of 21.5, the PMMA had an SP value of 18.6, and the SP ratio was 1.15.

TABLE 2

| | Proportion of sodium sulfoisophthalate copolymerized in PET copolymer (mol %) | Acid value of PMMA | Flattening ratio | Thickness of PET copolymer layer (micron) | Thickness of PMMA layer (micron) | Interference effect |
|---|---|---|---|---|---|---|
| C. Ex. B-1 | 0 | 8 | 2.3 | 0.38 | 0.40 | No color development recognized |
| Ex. B-1 | 0.3 | 8 | 3.2 | 0.31 | 0.33 | Slight interference color |
| Ex. B-2 | 0.6 | 8 | 4.2 | 0.20 | 0.23 | Considerable color (red) |
| Ex. B-3 | 1.0 | 8 | 4.5 | 0.09 | 0.10 | Interference color clearly recognized (red~orange) |
| Ex. B-4 | 2.5 | 8 | 5.0 | 0.08 | 0.09 | Interference color clearly recognized (red~orange) |
| Ex. B-5 | 5.0 | 8 | 5.1 | 0.07 | 0.09 | Interference color clearly recognized (green) |
| Ex. B-6 | 8.0 | 8 | 5.2 | 0.08 | 0.07 | Interference color clearly recognized (green) |
| C. Ex. B-2 | 10.5 | 8 | 5.3 | Difficult to form a fiber due to yarn breakage | | |
| C. Ex. B-3 | 15.0 | 8 | 5.2 | Difficult to form a fiber due to yarn breakage | | |
| C. Ex. B-4 | 2.5 | 1 | 2.8 | 0.35 | 0.38 | Very slight interference color |

Ex.: Example,
C. Ex.: Comparative Example

Example B-7

A polyethylene terephthalate copolymer having 1.5 mol % of sodium sulfoisophthalate copolymerized and having an intrinsic viscosity of 0.50 and polymethyl methacrylate (PMMA) having an acid value of 8 and a melt flow rate, at 230° C., of 14 were used, and these were supplied to co-spin a fiber so that resin amount ratio was 6/1. A yarn was produced so as to have a flat cross section shown in FIG. 2 and have a 15-layered composite form. This as-spun yarn was drawn to 1.3 times with a roller-type drawing machine to give a drawn yarn having 75 denier/24 filaments. An electron microscopic photograph of cross section of this flat yarn was taken, and a polyethylene terephthalate copolymer layer (PET copolymer layer) and a polymethyl methacrylate layer (PMMA layer) were measured for a thickness in a central point and a thickness in point located ⅛ of the length of major axis far from end thereof, to determine average values.

When the above-obtained fiber was twisted and moved in a reciprocal motion to observe any breakage and fibril of the fiber, it showed high abrasion durability. The following Table 3 shows the evaluation results.

TABLE 3

| | Thickness of each layer of alternate laminate portion | | Thickness of | | |
|---|---|---|---|---|---|
| | Thickness of PET copolymer layer | Thickness of PMMA layer | PET copolymer layer of protective layer portion | Flattening ratio | Interference effect |
| Ex. B-7 | 0.10 micron | 0.12 micron | 3.3 micron | 4.6 | Considerable interference color observed (red) |

Ex.: Example

Examples C-1~C-4 and Comparative Examples C-1~C-3

0.9 Mole of dimethyl-2,6-naphthalate, 0.1 mol of dimethyl terephthalate, 2.5 mol of ethylene glycol and various amounts of sodium salt of 5-sulfoisophthalic acid were added, and further, 0.0008 mol of calcium acetate and 0.0002 mol of manganese acetate were used as an ester interchange catalyst. These were charged into a reactor, and while the mixture wasg stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant copolyester (PEN copolymer) had an intrinsic viscosity in the range of 0.55 to 0.59.

Further, nylon 6 (intrinsic viscosity=1.3) was used.

The PET copolymer/nylon 6=1/1 (weight) were co-spun at a rate of 1,500 m/minute so as to form a 15-layered composite form having a flat cross section shown in FIG. 1. This as-spun yarn was drawn to 2.0 times with a roller-type drawing machine to give a drawn yarn having 70 denier/24 filaments. An electron microscopic photograph of cross section of this flat yarn was taken, and a PEN copolymer layer and a nylon 6 layer were measured for a thickness in a central point and a thickness in point located ⅛ of the length of major axis far from end thereof, to determine average values. The following Table 4 shows the results.

TABLE 4

| | Proportion of sodium sulfoisophthalate copolymerized in PEN copolymer (mol %) | Flattening ratio | Thickness of PEN copolymer (micron) | Thickness of nylon layer (micron) | Interference effect |
|---|---|---|---|---|---|
| C. Ex. C-1 | 0 | 2.7 | 0.31 | 0.43 | No interference color |
| Ex. C-1 | 0.3 | 3.0 | 0.21 | 0.22 | Interference color slightly recognized |
| Ex. C-2 | 0.6 | 4.2 | 0.13 | 0.14 | Interference color clearly recognized (red~orange) |
| Ex. C-3 | 1.5 | 4.8 | 0.09 | 0.10 | Interference color clearly recognized (red~orange) |
| Ex. C-4 | 3.0 | 5.2 | 0.07 | 0.08 | Interference color clearly recognized (green) |
| C. Ex. C-2 | 6.0 | 5.5 | 0.06 | 0.08 | Difficult to form a fiber due to yarn breakage |
| C. Ex. C-3 | 10.0 | 5.5 | 0.07 | 0.07 | Difficult to form a fiber due to many yarn breakage |

Ex.: Example,
C. Ex.: Comparative Example

Example C-5

The same PEN copolymer as the PEN copolymer having 1.5 mol % of sodium sulfoisophthalate copolymerized and having an intrinsic viscosity of 0.58, obtained in Example C-3, and a nylon 66 resin having an intrinsic viscosity of 1.25 were supplied so as to have a ratio of 1/1 (weight) and co-spun, and a yarn was formed so as to have a flat cross section shown in FIG. 1 and a 15-layered composite form. This as-spun yarn was drawn to 1.8 times with a roller-type drawing machine to give a drawn yarn having 73 denier/24 filaments. An electron microscopic photograph of cross section of this flat yarn was taken, and a PEN copolymer layer and a nylon 66 layer were measured for a thickness in a central point and a thickness in point located ⅛ of the length of major axis far from end thereof, to determine average values. The following Table 5 shows the results.

TABLE 5

| | Proportion of sodium sulfoisophthalate copolymerized in PEN copolymer (mol %) | Flattening ratio | Thickness of PEN copolymer | Thickness of nylon 66 layer | Interference effect |
|---|---|---|---|---|---|
| Ex. C-5 | 1.5 | 4.4 | 0.10 micron | 0.12 micron | Interference color clearly recognized (red~orange) |

Ex.: Example

Example C-6

Figure 2:
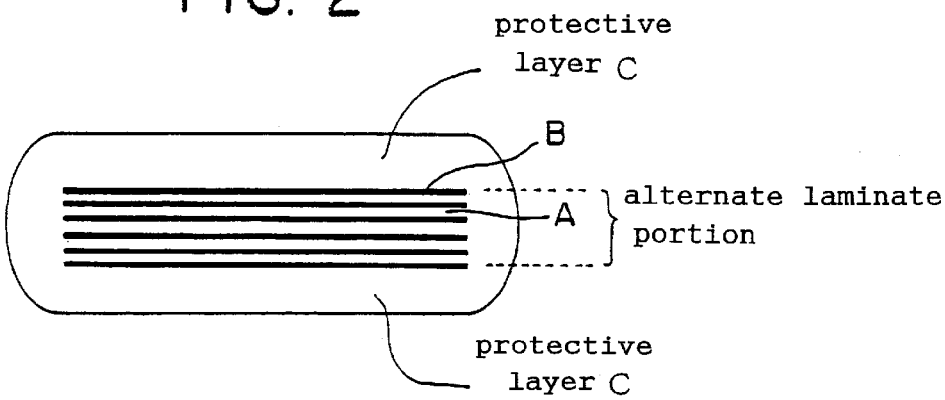
FIG. 2 is a schematic cross-sectional view of another fiber having the optical-interference function of the present invention.
Figure 3:
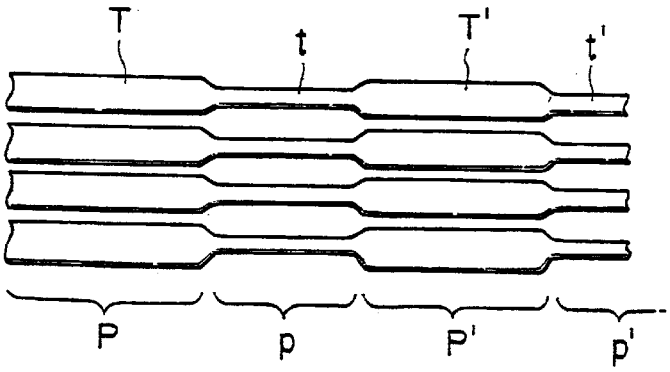
FIG. 3 is a schematic side view of a multi-filament yarn having the optical-interference function of producing different colors of the present invention.
Figure 4:
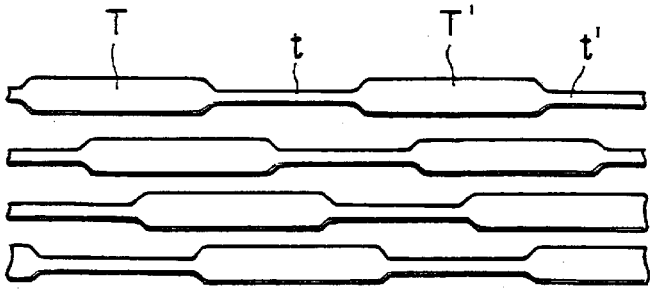
FIG. 4 is a schematic side view of another multi-filament yarn having the optical-interference function of producing different colors of the present invention.
Figure 5:
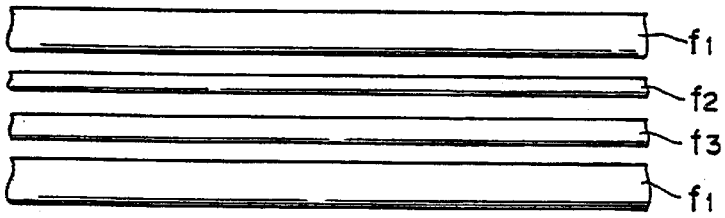
FIG. 5 is a schematic side view of another multi-filament yarn having the optical-interference function of producing different colors of the present invention.
Figure 6:
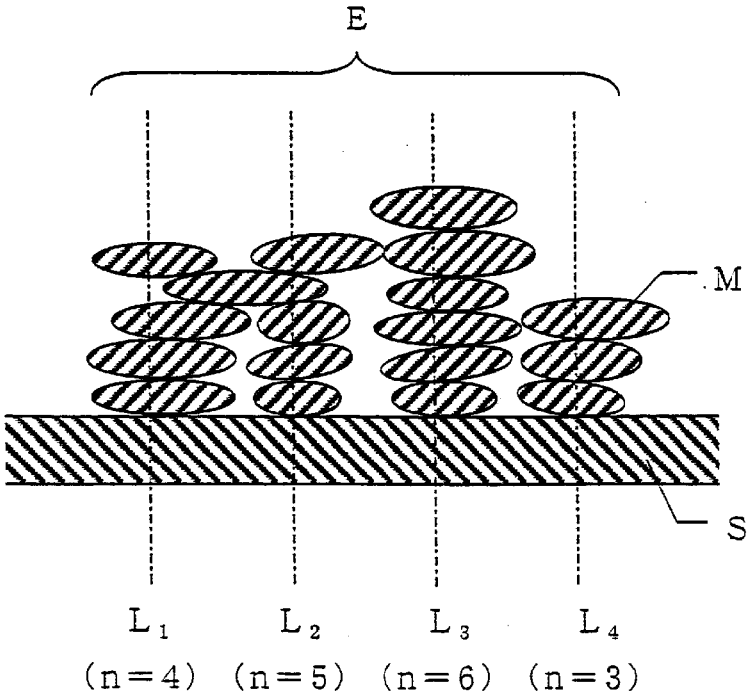
FIG. 6 is a schematic cross-sectional view of an embroidery fabric according to the present invention.

The same PEN copolymer as the PEN copolymer having 1.5 mol % of sodium sulfoisophthalate copolymerized and having an intrinsic viscosity of 0.58, obtained in Example 2, and a nylon 66 resin having an intrinsic viscosity of 1.3 were supplied so as to have a ratio of 6/1 (weight) and co-spun, and a yarn was formed so as to have a flat cross section shown in FIG. 2 and a 15-layered composite form. This as-spun yarn was drawn to 1.8 times with a roller-type drawing machine to give a drawn yarn having 73 denier/24 filaments. An electron microscopic photograph of cross section of this flat yarn was taken, and a PEN copolymer layer and a nylon 66 layer were measured for a thickness in a central point and a thickness in point located ⅛ of the length of major axis far from end thereof, to determine average values. The following Table 6 shows the results.

When the above-obtained fiber was twisted and moved in a reciprocal motion to observe any breakage and fibril of the fiber, it showed high abrasion durability.

TABLE 6

| | Thickness of each layer of alternate laminate portion | | Thickness of | | |
|---|---|---|---|---|---|
| | Thickness of PET copolymer layer | Thickness of nylon 66 layer | PEN copolymer layer of protective layer portion | Flattening ratio | Interference effect |
| Ex. C-6 | 0.09 micron | 0.10 micron | 3.0 micron | 5.0 | Interference color clearly recognized (red~orange) |

Ex.: Example

Examples D-1~D-5 and Comparative Examples D-1~D-4

1.0 Mole of dimethyl terephthalate, 2.5 mol of ethylene glycol and various amounts of neopentyl glycol were added, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant polyethylene terephthalate copolymer (PET copolymer) had an intrinsic viscosity in the range of 0.68 to 0.72.

Further, as polymethyl methacrylate (PMMA), Acrypet MF (melt flow rate at 230° C.=14) manufactured by Mitsubishi Rayon Co., Ltd. was used.

The PET copolymer/PMMA=1/1 (weight) were co-spun at a rate of 2,000 m/minute so as to form a 15-layered composite form having a flat cross section shown in FIG. 1. This as-spun yarn was drawn to 1.5 times with a roller-type drawing machine to give a drawn yarn having 80 denier/24 filaments. An electron microscopic photograph of cross section of this flat yarn was taken, and a PET copolymer layer and a PMMA layer were measured for a thickness in a central point and a thickness in point located ⅛ of the length of major axis far from end thereof, to determine average values. The following Table 7 shows the results.

TABLE 7

| | Proportion of neopentyl glycol copolymerized in PET copolymer (%) | Flattening ratio | Thickness of PET copolymer layer (micron) | Thickness of PMMA layer (micron) | Interference effect |
|---|---|---|---|---|---|
| C. Ex. D-1 | 0 | 2.3 | 0.38 | 0.40 | Color development not recognized |
| C. Ex. D-2 | 3 | 3.2 | 0.31 | 0.33 | Very slight interference color |
| Ex. D-1 | 6 | 4.2 | 0.20 | 0.23 | Considerable color (red) |
| Ex. D-2 | 10 | 4.8 | 0.09 | 0.10 | Interference color clearly recognized (red~orange) |
| Ex. D-3 | 15 | 5.2 | 0.07 | 0.08 | Interference color clearly recognized (red~orange) |
| Ex. D-4 | 20 | 5.5 | 0.06 | 0.08 | Interference color clearly recognized (green) |
| Ex. D-5 | 25 | 5.5 | 0.07 | 0.07 | Interference color clearly recognized (green) |
| C. Ex. D-3 | 35 | Difficult to form a fiber due to yarn breakage | | | |
| C. Ex. D-4 | 40 | Difficult to form a fiber due to yarn breakage | | | |

Ex.: Example,
C. Ex.: Comparative Example

Examples D-6~D-10 and Comparative Examples D-5~D-8

1.0 Mole of dimethyl terephthalate, 2.5 mol of ethylene glycol and various amounts of an adduct of bisphenol A with ethylene oxide were added, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant polyethylene terephthalate copolymer (PET copolymer) had an intrinsic viscosity in the range of 0.66 to 0.73.

Further, as polymethyl methacrylate (PMMA), Acrypet MF (melt flow rate at 230° C.=14) manufactured by Mitsubishi Rayon Co., Ltd. was used.

The PET copolymer/PMMA=1/1 (weight) were co-spun at a rate of 2,000 m/minute so as to form a 15-layered composite form having a flat cross section shown in FIG. 1. This as-spun yarn was drawn to 1.5 times with a roller-type drawing machine to give a drawn yarn having 80 denier/24 filaments. An electron microscopic photograph of cross section of this flat yarn was taken, and a PET copolymer layer and a PMMA layer were measured for a thickness in a central point and a thickness in point located ⅛ of the length of major axis far from end thereof, to determine average values. The following Table 8 shows the results.

TABLE 8

| | Proportion of adduct of bisphenol A with ethylene oxide copolymerized in PET copolymer (%) | Flattening ratio | Thickness of PET copolymer layer (micron) | Thickness of PMMA layer (micron) | Interference effect |
|---|---|---|---|---|---|
| C. Ex. D-5 | 0 | 2.3 | 0.38 | 0.40 | Color development not recognized |
| C. Ex. D-6 | 4 | 3.4 | 0.31 | 0.32 | Very slight interference color |
| Ex. D-6 | 6 | 4.3 | 0.18 | 0.21 | Considerable color (red) |
| Ex. D-7 | 11 | 4.6 | 0.10 | 0.12 | Interference color clearly recognized (orange~yellow) |
| Ex. D-8 | 17 | 5.4 | 0.06 | 0.08 | Interference color clearly recognized (yellow~green) |
| Ex. D-9 | 20 | 5.4 | 0.06 | 0.08 | Interference color clearly recognized (green) |
| Ex. D-10 | 25 | 5.5 | 0.06 | 0.06 | Interference color clearly recognized (blue) |
| C. Ex. D-7 | 35 | Difficult to form a fiber due to yarn breakage | | | |
| C. Ex. D-8 | 40 | Difficult to form a fiber due to yarn breakage | | | |

Ex.: Example,
C. Ex.: Comparative Example

Examples D-11

The same PET copolymer as the PET copolymer having 11 mol % of an adduct of bisphenol A with ethylene oxide copolymerized, used in Example D-7, and Acrypet MF (melt flow rate at 230° C. or lower=14) of Mitsubishi Rayon Co., Ltd. as a polymethyl methacrylate (PMMA) were used.

The polyethylene terephthalate copolymer/PMMA=4/1 (weight) were co-spun at a rate of 2,000 m/minute so as to form a yarn having a 15-layered composite form and having a flat cross section having a protective layer portion on the circumferential portion of an alternate laminate portion, shown in FIG. 2. This as-spun yarn was drawn to 1.6 times with a roller-type drawing machine to give a drawn yarn having 90 denier/12 filaments. An electron microscopic photograph of cross section of this flat yarn was taken, and a PET copolymer layer and a PMMA layer were measured for a thickness in a central point and a thickness in point located ⅛ of the length of major axis far from end thereof, to determine average values.

Further, a load of 0.02 g/d was applied to the above-produced yarn, the fiber was twisted one turn, and the yarn was repeatedly moved 3,000 times in a reciprocal motion for observing a change of the fiber against abrasion. Table 9 shows the results. In Example 11 having the protective portion, no fibril of the fiber was observed.

On the other hand, the fiber of Example D-8 showed the formation of fibrils in the same abrasion test, and the electron microscopic observation thereof showed that part of its alternate laminate portion was broken.

TABLE 9

| | Flattening ratio | Thickness of non-laminated region layer (micron) | Thickness of PET copolymer layer (micron) | Thickness of PMMA layer (micron) | Interference effect |
|---|---|---|---|---|---|
| Ex. D-11 | 4.7 | 4.2 | 0.09 | 0.10 | Color development clearly recognized (yellow). No fibril formed in abrasion test. |
| Ex. D-8 | 4.6 | — | 0.10 | 0.12 | Color development clearly recognized (orange~yellow). Fibril formed in abrasion test and interference color decreased. |

Ex.: Example

Example D-12

0.9 Mole of dimethyl terephthalate, 0.1 mol of dimethyl (2-methyl)terephthalate and 2.5 mol of ethylene glycol were added, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature. increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant polyethylene terephthalate copolymer (PET copolymer) had an intrinsic viscosity of 0.64, and the amount of methyl terephthalate copolymerized was 9.8%.

Further, as polymethyl methacrylate (PMMA), Acrypet MF (melt flow rate at 230° C.=14) manufactured by Mitsubishi Rayon Co., Ltd. was used.

The PET copolymer and PMMA were supplied so as to have a PET copolymer/PMMA=1/1 (weight) and co-spun to form a yarn having a flat cross section shown in FIG. 1 and having a 15-layered composite form. This as-spun yarn was drawn to 1.3 times with a roller-type drawing machine to give a drawn yarn having 80 denier/24 filaments. An electron microscopic photograph of cross section of this flat yarn was taken, and a PET copolymer layer and a PMMA layer were measured for a thickness in a central point and a thickness in point located ⅛ of the length of major axis far from end thereof, to determine average values. The following Table 10 shows the results.

TABLE 10

| | Flattening ratio | Thickness of PET copolymer layer (micron) | Thickness of PMMA layer (micron) | Interference effect |
|---|---|---|---|---|
| Ex.D-12 | 4.5 | 0.08 | 0.07 | Interference color clearly recognized (yellow~green) |

Ex.: Example

Comparative Example D-9

0.88 Mole of dimethyl terephthalate, 0.12 mol of dimethyl sebacate and 2.5 mol of ethylene glycol were added, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant polyethylene terephthalate copolymer (PET copolymer) had an intrinsic viscosity of 0.64, and the amount of methyl terephthalate copolymerized was 9.8%.

Further, as polymethyl methacrylate (PMMA), Acrypet MF (melt flow rate at 230° C.=14) manufactured by Mitsubishi Rayon Co., Ltd. was used.

The PET copolymer and PMMA were supplied so as to have a PET copolymer/PMMA=1/1 (weight) and co-spun to form a yarn having a flat cross section shown in FIG. 1 and having a 15-layered composite form. This as-spun yarn was drawn to 1.4 times with a roller-type drawing machine to give a drawn yarn having 78 denier/24 filaments. An electron microscopic photograph of cross section of this flat yarn was taken, and a PET copolymer layer and a PMMA layer were measured for a thickness in a central point and a thickness in point located ⅛ of the length of major axis far from end thereof, to determine average values. The following Table 11 shows the results.

When the above PET copolymer containing a copolymer component having no alkyl group in a side chain was used, no optical interference effect was recognized in the obtained fiber.

TABLE 11

| | Flattening ratio | Thickness of PET copolymer layer (micron) | Thickness of PMMA layer (micron) | Interference effect |
|---|---|---|---|---|
| C.Ex.D-9 | 2.8 | 0.32 | 0.35 | Color development not recognized |

Ex.: Example

Examples E-1~E-4 and Comparative Examples E-1~E-2

Panlite AD-5503 manufactured by Teijlin Chemicals Ltd. was used as polycarbonate (PC), and Acrypet MF (melt flow rate at 230° C.=14) manufactured by Mitsubishi Rayon Co., Ltd. was used as polymethyl methacrylate (PMMA). While the relationship of PC/PMMA=1/1 (weight) was maintained, the extrusion amount was adjusted and they were co-spun (SP ratio=1.1) at a rate of 2,000 m/minute to form a fiber having a flat cross section shown in FIG. 1 and having a 30-layered composite form. This as-spun yarn was drawn to 1.5 times with a roller-type drawing machine to give a drawn yarn of 24 filaments. An electron microscopic photograph of cross section of this flat yarn was taken, and a PC layer and a PMMA layer were measured for a thickness in a central point and thickness in point located ⅛ of the length of major axis far from end thereof, to determine average values. The following Table 12 shows the results.

TABLE 12

| | Feed amounts of PC/PMMA polymers (g/minute) | Flattening ratio | Thickness of PC layer (micron) | Thickness of PMMA Layer (micron) | Interference effect |
|---|---|---|---|---|---|
| C. Ex. E-1 | 30/30 | 7.3 | 0.45 | 0.47 | Color development not recognized |
| C. Ex. E-2 | 20/20 | 7.2 | 0.33 | 0.32 | Color development not recognized |
| Ex. E-1 | 15/15 | 7.4 | 0.24 | 0.26 | Color development slightly recognized (red) |
| Ex E-2 | 10/10 | 7.5 | 0.13 | 0.12 | Color development clearly recognized (red~orange) |
| Ex. E-3 | 6/6 | 7.2 | 0.07 | 0.08 | Color development clearly recognized (red~orange) |
| Ex. E-4 | 4/4 | 5.5 | 0.07 | 0.08 | Color development clearly recognized (green) |

Ex.: Example,
C. Ex.: Comparative Example

Example E-5

Panlite AD-5503 manufactured by Teijin Chemicals Ltd. was used as polycarbonate (PC), and Acrypet MF (melt flow rate at 230° C.=14) manufactured by Mitsubishi Rayon Co., Ltd. was used as polymethyl methacrylate (PMMA). These were supplied so as to have a resin amount ratio of 6/1 and co-spun to form a fiber having a flat cross section shown in FIG. 2 and having a 15-layered composite form. This base yarn was drawn to 1.5 times with a roller-type drawing machine to give a drawn yarn of 76 denier/24 filaments. An electron microscopic photograph of cross section of this flat yarn was taken, and a polycarbonate layer and a PMMA layer were measured for a thickness in a central point and a thickness in point located ⅛ of the length of major axis far from end thereof, to determine average values.

The obtained composite fiber was twisted and moved in a reciprocal motion to observe any breakage and fibril of the fiber, it showed high abrasion durability.

The following Table 13 shows the properties and optical interference effect of the obtained fiber.

TABLE 13

| | Thickness of each layer of alternate laminate portion | | | | |
|---|---|---|---|---|---|
| | Thickness of PC layer (micron) | Thickness of PMMA layer (micron) | Thickness of PC layer of protective layer portion | Flattening ratio | Interference effect |
| Ex. E-5 | 0.12 | 0.12 | 3.2 | 4.8 | Interference color considerably recognized (red) |

Ex.: Example

Examples F-1~F-2

1.0 Mole of dimethyl terephthalate and 2.5 mol of ethylene glycol were used, and further, 0.0008 mol of calcium acetate and 0.0002 mol of manganese acetate were used as an ester interchange catalyst. These were charged into a reactor, and while the mixture was stirred, it was gradually heated from 150° C. to 230° C. to carry out an ester interchange reaction in accordance with a conventional method. A predetermined amount of methanol was withdrawn from the system, then 0.0008 mol of antimony trioxide and 0.0012 mol of triethyl phosphate ester were charged as a polymerization catalyst, temperature increasing and pressure reduction were gradually carried out, and while generated ethylene glycol was withdrawn, the reactor was allowed to reach 285° C. and the vacuum degree was allowed to reach not more than 1 Torr. These conditions were maintained until a viscosity increased, and when a torque on a stirrer reached a predetermined value, the reaction was terminated. The reaction product was extruded into water to give pellets. The resultant polyester (PET) had an intrinsic viscosity of 0.64.

Further, as other polymer, nylon 6 (intrinsic viscosity=1.3) was used. The PET/nylon 6=1/1 (weight) were co-spun at a rate of 1,500 m/minute to form a yarn having a flat cross section shown in FIG. 1 and having a 30-layered composite form. This as-spun yarn was drawn to 2.0 times with a roller-type drawing machine to give a drawn yarn having 70 denier/24 filaments. An electron microscopic photograph of cross section of this flat yarn was taken, and a PET layer and a nylon 6 layer were measured for a thickness in a central point and a thickness in point located ⅛ of the length of major axis far from end thereof, to determine average values. The following Table 14 shows the results.

TABLE 14

| | Flattening ratio | Thickness of PET layer (micron) | Thickness of nylon layer (micron) | Interference effect |
|---|---|---|---|---|
| Ex. F-1 | 11.9 | 0.75 | 0.78 | Blue color developed intensely |
| Ex. F-2 | 8.6 | 0.88 | 0.92 | Green color developed intensely |

Ex.: Example

Example F-3

PET additionally copolymerized with 0.1 mol of sodium 5-sulfoisophthalate was used in place of the PET used in Examples F-1~F-2, and the PET and nylon 6 were supplied to have a ratio of 3/2 (weight) and co-spun to form a yarn having a flat cross section shown in FIG. 2 and having a 30-layered composite form in an alternate laminate portion. This as-spun yarn was drawn to 1.3 times with a roller-type drawing machine to give a drawn yarn having 75 denier/24 filaments. An electron microscopic photograph of cross section of this flat yarn was taken, and a PET layer and a nylon 6 layer were measured for a thickness in a central point and a thickness in point located ⅛ of the length of major axis far from end thereof, to determine average values. In evaluation results, the thickness of the PET layer of the alternate laminate portion was 0.88 micron, the thickness of the nylon 6 layer thereof was 0.92 micron, and the thickness of the protective layer portion (PET layer) was 3.3 micron. The obtained fiber showed a clear interference color (red).

Examples G-1~G-3 and Comparative Examples G-1~G-2

Polyethylene-2,6-naphthalate (PEN, manufactured by Teijin Limited), polyethylene-2,6-naphthalate having 0.6 mol % of sodium sulfoisophthalate copolymerized (PE-N1 copolymer), polyethylene-2,6-naphthalate having 0.6 mol % of sodium sulfoisophthalate and 10 mol % of isophthalic acid copolymerized (PEN-2 copolymer), nylon 6 (manufactured by Teijin Limited), polyethylene terephthalate (PET, manufactured by Teijin Limited), polypropylene (PP, manufactured by Tonen Co., Ltd.), polyphenylene sulfide (PPS) and polyvinylidene fluoride were combined as shown in Tables 15 and 16, and they were spun through a spinneret shown in FIG. 7 at a rate of 1,200 m/minute to form a fiber having a flat cross section shown in FIG. 1 and have a 30-layered alternately laminated product. This as-spun yarn was drawn to 2.0 times with a roller-type drawing machine to give a drawn yarn of 11 filaments. Table 16 shows the results.

In Example G-1, the flattening ratio was 4.2, the parallelism of an alternate laminate portion around the central portion of the flat cross section was nearly maintained and uniform. The multi-filament showed the development of a yellowish green color.

In Example G-2, there was used a polymer prepared by copolymerizing sodium sulfoisophthalate with polyethylene-2,6-naphthalate to improve the solubility with nylon 6. The flattening ratio was 4.8, the parallelism of an alternate laminate portion around the central portion of the flat cross section was remarkably uniform. The multi-filament showed the development of a green color.

In Example G-3, there was used a polymer prepared by further copolymerizing 10 mol % of isophthalic acid with the PEN-1 copolymer used in Example G-2 to improve the compatibility with nylon 6 and to decrease its melting point. The obtained fiber had a flattening ratio of 5.0, the alternate laminate portion around the central portion of the flat cross section was remarkably uniform. The multi-filament showed the development of a green color.

On the other hand, in Comparative Example G-1, the flattening ratio was 0.8, the yarn did not have a form shown in FIG. 1, and the parallelism of each layer of the alternate laminate portion was utterly non-uniform. No color was developed.

In Comparative Example G-2, the flattening ratio was 1.8, the yarn did not have a form shown in FIG. 1, and it had a form in which the central portion of the flat cross section swelled. No color was developed.

In Table 16, the parallelism of laminated layers and the brightness of developed color were measured by the following methods.

Parallelism of Laminated Layers

The cross section of a fiber was observed through an electron microscope, and each layer was measured for a thickness in a central point and a thickness in point located ⅛ of the length of major axis far from end thereof, to determine average values. The parallelism was determined as follows.

$$\textit{Parallelism of laminated layer} = \frac{\textit{Thickness of layer in central portion}}{\textit{Thickness of portion 1/8 of the length apart from end}}$$

Brightness of Developed Color

○ Development of clear color

Δ Development of slightly cloudy but bright color

× Transparent or white color

TABLE 15

| | Alternate laminate portion | | | | | | | |
|---|---|---|---|---|---|---|---|---|
| | Higher-melting point polymer | Refractive index ($n_1$) | SP value ($J^{1/2}$/mol) | mp (° C.) | Lower-melting point polymer | Refractive index ($n_2$) | SP value | mp (° C.) |
| Ex. G-1 | PEN | 1.68 | 20.5 | 268 | Nylon 6 | 1.53 | 22.5 | 233 |
| Ex. G-2 | PEN-1 copolymer | 1.68 | ~20.5 | 266 | Nylon 6 | 1.53 | 22.5 | 233 |
| Ex. G-3 | PEN-2 copolymer | 1.68 | ~20.5 | 257 | Nylon 6 | 1.53 | 22.5 | 233 |
| C. Ex. G-1 | PET | 1.63 | 20.5 | 256 | PP | 1.49 | 16.6 | 187 |
| C. Ex. G-2 | PPS | 1.82 | 19.6 | 357 | Polyvinylidene fluoride | 1.41 | 1.86 | 210 |

Ex.: Example,
C. Ex.: Comparative Example
PEN-1 copolymer: having 0.6 mol % of sodium sulfoisophthalate copolymerized.
PEN-2 copolymer: having 0.6 mol % of sodium sulfoisophthalate and 10 mol % of isophthalic acid copolymerized.

TABLE 16

| | | | | | Parallelism of laminated layers | | | |
|---|---|---|---|---|---|---|---|---|
| | | | Melting | | | | | |
| | | SP ratio | point difference | Flattening | Lower-melting | Higher-melting point | Color developability | |
| | $n_1/n_2$ | ($SP_1/S_2$) | (Δmp) | ratio | point polymer | polymer | Color | Brightness |
| Ex. G-1 | 1.10 | 0.91 | 35 | 4.2 | 1.23 | 1.15 | Yellowish green | ○ |
| Ex. G-2 | 1.10 | 0.91 | 33 | 4.8 | 1.06 | 1.10 | Green | ○ |
| Ex. G-3 | 1.10 | 0.91 | 24 | 5.0 | 1.04 | 1.06 | Green | ○ |
| C. Ex. G-1 | 1.09 | 1.23 | 69 | 0.8 | 2.10 | 1.50 | Transparent | X |
| C. Ex. G-2 | 1.29 | 1.05 | 147 | 1.8 | 2.01 | 1.89 | Transparent | X |

Ex.: Example,
C. Ex.: Comparative Example

Examples G-4~G-5 and Comparative Example G-3

The polymers used in Example G-3 were combined as shown in Table 17, and they were spun through the above-described spinneret at a rate of 1,200 m/minute to form a yarn having a flat cross section shown in FIG. 2 and having a structure of a 30-layered alternate laminate portion and a protective layer portion. This as-spun yarn was drawn to 2.0 times with a roller-type drawing machine to give a drawn yarn of 11 filaments.

In Example G-4, the alternate laminate portion was formed of a combination of the polymers shown in Example G-3, and further, the protective layer portion was formed of the PEN-2 copolymer which was a higher-melting-point polymer of the two polymers forming the alternate laminate portion. The fiber had a flattening ratio of 6.2, and the layer thickness was remarkably uniform throughout the flat cross section thereof. When the fiber was examined for color developability, it showed a bluish green color and the development of intense color was observed.

In Example G-5, the fiber had the same alternate laminate portion as that of the fiber in Example G-4, and the protective layer portion was formed of the nylon 6 which was a lower-melting point polymer. The fiber had a flattening ratio of 5.6, and the layer thickness was remarkably uniform throughout the flat cross section thereof. The multi-filament showed a bluish green color, and the development of intense color was observed.

In Comparative Example G-3, the fiber had the same flat cross-sectional structure as that shown in FIG. 1 and had no protective layer formed of the same polymer as that in Example G-4. Similarly to Example G-3, the fiber had a flattening ratio of 5.0, and the layer thickness was remarkably uniform around the central portion of the flat cross section, while the parallelism on end portions was non-uniform.

Tables 17 and 18 summarize the results of Examples G-4 and G-5 and Comparative Examples G-3.

TABLE 17

| | Alternate laminate portion | | | | | | | | Polymer forming |
|---|---|---|---|---|---|---|---|---|---|
| | Higher-melting point polymer | Refractive index ($n_1$) | SP value ($J^{1/2}$/mol) | mp (° C.) | Lower-melting point polymer | Refractive index ($n_2$) | SP value | mp (° C.) | a protective layer portion |
| Ex. G-4 | PEN-2 copolymer | 1.68 | ~20.5 | 257 | Nylon 6 | 1.53 | 22.5 | 233 | PEN-2 copolymer |
| Ex. G-5 | PEN-2 copolymer | 1.68 | ~20.5 | 257 | Nylon 6 | 1.53 | 22.5 | 233 | Nylon 6 |
| C. Ex. G-3 | PEN-2 copolymer | 1.68 | ~20.5 | 257 | Nylon 6 | 1.53 | 22.5 | 233 | — |

Ex .: Example,
C. Ex.: Comparative Example
PEN-1 copolymer: having 0.6 mol % of sodium sulfoisophthalate copolymerized.
PEN-2 copolymer: having 0.6 mol % of sodium sulfoisophthalate and 10 mol % of isophthalic acid copolymerized.

TABLE 18

| | $n_1/n_2$ | SP ratio ($SP_1/SP_2$) | Melting point difference (Δmp) | Presence of non-laminated portion | Flattening ratio | Parallelism of laminated layers: Low n polymer | Parallelism of laminated layers: High n polymer | Color developability: Color | Color developability: Brightness |
|---|---|---|---|---|---|---|---|---|---|
| Ex. G-4 | 1.10 | 0.91 | 24 | Yes | 6.2 | 1.00 | 1.00 | Bluish green | ○ |
| Ex. G-5 | 1.10 | 0.91 | 24 | Yes | 5.6 | 1.02 | 1.04 | Bluish green | ○ |
| C. Ex. G-3 | 1.10 | 0.91 | 24 | No | 5.0 | 1.04 | 1.06 | Green | Δ |

Ex.: Example,
C. Ex.: Comparative Example

Examples H-1~H-8 and Comparative Examples H-1~H-4

Polyethylene-2,6-naphthalate having 1.5 mol % of sodium sulfoisophthalate copolymerized (n=1.63, SP value=21.5 (calculated), melting point=260° C., intrinsic viscosity=0.58) and nylon 6 (n=1.53, SP value=22.5, melting point=235° C., intrinsic viscosity=1.25) were used, and these were spun through a spinneret shown in FIG. 10 at a spinneret temperature of 275° C. at a take-up rate of 1,200 m/minute. Then, the resultant yarn was drawn at a draw ratio of 2 times at a draw temperature (surface temperature of feed roller) of 110° C. and at a set temperature of 140° C. (surface temperature of drawing roller) and taken up. In this case, the cross-sectional form was flat, the number of laminated layers of the alternate laminate portion was 30, and a protective layer made of the polyethylene-2,6-naphthalate copolymer was formed on the circumferential portion of the alternate laminate portion. Multi-filament yarns of 11 filaments whose flattening ratios had been changed as shown in Table 19 were obtained. These yarns were used as wefts for textiles of weft satin texture while black-colored spun dye multi-filaments were used as warps to weave textiles. On the basis of photographs of cross sections of wefts of the textiles, flat cross sections were evaluated for orientation degrees. Table 19 shows the results. As shown in Table 19, the orientation degrees were low when flattening ratios were 3.5 or less, while high orientation degrees were attained when the flattening ratios were 4.0 or more.

The orientation degrees of the flat cross sections (to be referred to as "flat surface orientation degree") and optical interference functions (brightness of color formed by interference) are values obtained by measurements according to the following methods.

Flat Surface Orientation Degree

When the smaller angle of angles formed by a textile surface and a surface of each filament in a flat major axis direction is taken as θ, an average is determined by $$\bar{\theta} = \frac{\sum_n \theta i}{n}$$

(n=10 in measurements).

$$\text{Flat surface orientation degree (\%)} = 100 - (\bar{\theta}/90) \times 100$$

Optical Interference Function

Textile surfaces were visually observed under constant light quantity indoors to evaluate the textiles as follows.

TABLE 19

| No. | Flattening ratio | Flat surface orientation degree (%) | Brightness of color formed by interference | Remarks |
|---|---|---|---|---|
| C. Ex. H-1 | 2.0 | 52 | X | |
| C. Ex. H-2 | 3.0 | 54 | X | |
| C. Ex. H-3 | 3.5 | 54 | X | |
| Ex. H-1 | 4.0 | 67 | Δ | |
| Ex. H-2 | 4.5 | 72 | Δ~○ | |
| Ex. H-3 | 5.0 | 76 | ○ | |
| Ex. H-4 | 6.0 | 82 | ○ | |
| Ex. H-5 | 8.0 | 85 | ○ | |
| Ex. H-6 | 10.0 | 91 | ○ | |
| Ex. H-7 | 12.0 | 93 | ○ | Sometimes bent in cross section in use |
| Ex. H-8 | 15.0 | 93 | ○~Δ | Sometimes bent in cross section in use |
| C. Ex. H-4 | 17.0 | 94 | Δ | Defective flat form in spinning |

Ex.: Example,
C. Ex.: Comparative Example

Examples H-9~H16 and Comparative Examples H-5~H-9

Multi-filament yarns of 11 filaments each were obtained in the same manner as in Examples H-1~H-8 except that the flattening ratio was changed to 6.5 and that the number of layers of each alternate laminate portion was changed to that in Table 20. Further, textiles were obtained in the same manner as in Examples H-1~H-8, and evaluated for the number of defective lamination portions and a brightness of a color formed by interference. Table 20 shows the results. According to Table 20, so long as the number of laminated layer was 10 or less, the color formed by interference was insufficient, while when it exceeded 15, a color formed by interference became bright.

TABLE 20

| No. | Number of laminated layers | Flat surface orientation degree (%) | Brightness of color formed by interference | Remarks |
|---|---|---|---|---|
| C. Ex. H-5 | 7 | 82 | X | |
| C. Ex. H-6 | 10 | 83 | X | |
| C. Ex. H-7 | 13 | 80 | X | |
| Ex. H-9 | 15 | 81 | Δ | |
| Ex. H-10 | 20 | 83 | Δ~○ | |
| Ex. H-11 | 25 | 80 | ○ | |
| Ex. H-12 | 50 | 82 | ○ | |
| Ex. H-13 | 60 | 81 | ○~Δ | |
| Ex. H-14 | 80 | 83 | ○~Δ | |
| Ex. H-15 | 100 | 80 | Δ | |
| Ex. H-16 | 120 | 78 | Δ | |
| C. Ex. H-8 | 130 | 78 | X | High fluctuation of lamination |
| C. Ex. H-9 | 150 | 78 | X | High fluctuation of lamination |

Ex.: Example,
C. Ex.: Comparative Example

Example G-17~H-21 and Comparative Example H-10~H-13

Spun-and-taken-up undrawn yarns (flattening ratio of 6.5, 30 laminated layers, 11 filaments) obtained in the same manner as in Examples H-1~H-8 were drawn at a draw ratio shown in Table 21 at a draw temperature of 110° C. Table 21 shows the results. As is clearly shown in Table 21, when the elongation became 50% or less, the color formed by interference was bright as compared with the undrawn yarns. However, when the elongation was as low as less than 10%, yarn breakage frequently occurred in weaving textiles.

The elongation was measured by the following method.

Elongation: measured with RTM-300 TENSILON tensile tester manufactured by Toyo Baldwin Co., Ltd at a tension length of 20 cm at a tension rate of 200 mm/minute (n=5 was employed by taking a variability in consideration).

TABLE 21

| | Draw ratio (times) | Elongation (%) | Flat surface orientation degree (%) | Brightness of color formed by interference |
|---|---|---|---|---|
| C. Ex. H-10 | Not drawn | 170 | 80 | X |
| C. Ex. H-11 | 1.3 | 100 | 81 | X |
| C. Ex. H-12 | 1.45 | 60 | 82 | X |
| Ex. H-17 | 1.6 | 50 | 81 | Δ |
| Ex. H-18 | 1.8 | 40 | 83 | ○ |
| Ex. H-19 | 2.1 | 30 | 81 | ○ |
| Ex. H-20 | 2.5 | 20 | 82 | ○ |
| Ex. H-21 | 2.8 | 10 | 81 | ○ |
| C. Ex. H-13 | 3.1 | 5 | 82 | Δ~○ |

Ex.: Example,
C. Ex.: Comparative Example

Examples I-1

Polyethylene-2,6-naphthalate having 1.5 mol % of sodium sulfoisophthalate copolymerized and nylon 6 were spun through a spinneret shown in FIG. 10 at a take-up rate of 1,200 m/minute, to give a multi-bundled undrawn yarn. The constituent filaments had a flat cross section shown in FIG. 2 and had a flattening ratio of 5.5, and the number of laminated layers of its alternate laminate portion was 30. A protective layer portion made of polyethylene-2,6-naphthalate was formed on. the circumferential portion of the alternate laminate portion. The number of filaments was 11, and the yarn had an elongation of 170%. This undrawn yarn was drawn between two pairs of rollers by varying the speed of a feed roller so that changes in the stretch ratio were 0 times, 1.6 times, 1.8 times and 2.5 times in the longitudinal direction. A portion drawn 0 times formed a color of red by interference, a portion drawn 1.6 times formed a color of yellow by interference, a portion drawn 1.8 times formed a color of green by interference, and a portion drawn 2.5 times formed a color of blue by interference. When the yarn was woven into a textile, the textile shone with metallic gloss of multi-colors, was artificial and formed graceful colors. In this case, when each of the laminated layers was measured for a thickness (μm), the polyethylene-2,6-naphthalate layer/nylon 6 layer drawn 0 times were 0.0928/0.0989 thick, those drawn at DR (draw ratio) of 1.6 were 0.0890/0.0948 thick, those drawn at DR of 1.8 were 0.0767/0.0817 thick, and those drawn at DR of 2.5 were 0.0667/0.0711 thick.

Example I-2

An undrawn yarn was obtained in the same manner as in Example I-1, and it was drawn in the same manner as in Example I-1 except that the multi-filament was opened by providing a rod-like rubbing guide immediately after the feed roller and that drawing points of the constituent filaments were varied by providing a mat-processed iron plate immediately thereafter. As compared with the yarn of Example I-1, the multi-color mix thereof was very fine, whereby the development of a unique graceful color was attained.

Example I-3

An undrawn yarn was obtained in the same manner as in Example I-1 except the use of 7 levels of extrusion openings. The constitution of said extrusion openings was such that 1 level was the 0.13 mm×0.25 mm extrusion opening (base opening), three levels of extrusion openings with larger dimension than said base opening, each being obtained by increasing every 0.01 mm to the base value of 0.13 mm and each being every 0.02 mm to the base value of 0.25 mm, and other these levels of extrusion openings with smaller dimension than said base extrusion opening, each being obtained by decreasing every 0.01 mm to the base value of 0.13 mm and every 0.02 mm to the base value of 0.25 mm. Two filaments were each spun at 7 levels in total to obtain an undrawn yarn of 14 filaments. This undrawn yarn was uniformly drawn at a draw ratio of 2.0 times at a roller temperature of 110° C. As a result, the constituent filaments gave interference colors which were little by little changed from yellow to blue through green and had a depth. A graceful textile was obtained from the yarn.

Examples J-1~J-3 and Comparative Example J-1

Polyethylene-2,6-naphthalate having 1.5 mol % of sodium sulfoisophthalate copolymerized (n=1.63, SP value=21.5 (calculated), melting point=260° C., intrinsic viscosity=0.58) and nylon 6 (n=1.53, SP value=22.5, melting point=235° C., intrinsic viscosity=1.25) were used, and these were spun through a spinneret shown in FIG. 10 at a spinneret temperature of 275° C. at a take-up rate of 1,200 m/minute. And, the resultant yarn was drawn at a draw ratio of 2 times at a draw temperature (surface temperature of feed roller) of 110° C. and at a set temperature of 140° C. (surface temperature of drawing roller) and taken up. In this case, the cross-sectional form was flat, the number of laminated layers of the alternate laminate portion was 30, and a protective layer made of the polyethylene-2,6-naphthalate copolymer was formed on the circumferential portion of the alternate laminate portion. Multi-filament yarns of 11 filaments having a flattening ratio of 6.0 were obtained. These yarns were twisted by a twister at 0 T/M, 300 T/M, 600 T/M and 850 T/M, respectively, and the multi-filament yarns were used as wefts for textiles of weft satin texture while black-colored spun dye multi-filaments were used as warps to weave textiles. The textiles were evaluated for optical interference functions. The results were as shown in Table 22, and when the twisting number was 300 to 850 T/M, high color development was attained at wide angles as well.

TABLE 22

| No. | Twisting number (T/M) | Interference color developability 0°/0° | 20°/20° | 40°/40° | 60°/60° |
|---|---|---|---|---|---|
| C.Ex.J-1 | 0 | ○ | Δ | X | X |
| Ex.J-1 | 300 | ○ | ○ | ○ | ○ |
| Ex.J-2 | 600 | ○ | ○ | ○ | ○ |
| Ex.J-3 | 850 | ○ | ○ | ○ | ○ |

Ex.: Example, C.Ex.: Comparative Example

In Table, ○ means a clear color, Δ means a slightly cloudy but bright color, and × means a transparent or white color.

Examples J-4~J-6 and Comparative Example J-2

Multi-filament yarns spun and drawn in the same manner as in Examples J-1~J3 were false-twisted respectively at false-twisting numbers of 0 T/M, 300 T/M, 600 T/M and 850 T/M at room temperature. These multi-filament yarns were formed into textiles in the same manner as in Examples J-1~J-3, and the textiles were evaluated for the development of interference color. Table 23 shows the results. When the false-twisting number was from 300 T/M to 850 T/M, the development of a clear color was observed even at incidence angle/light receiving angle=60°/60°.

TABLE 23

| No. | Twisting number (T/M) | Interference color developability 0°/0° | 20°/20° | 40°/40° | 60°/60° |
|---|---|---|---|---|---|
| C.Ex.J-2 | 0 | ○ | Δ | X | X |
| Ex.J-4 | 300 | ○ | ○ | ○ | Δ |
| Ex.J-5 | 600 | ○ | ○ | ○ | ○ |
| Ex.J-6 | 850 | ○ | ○ | ○ | ○ |

Ex.: Example, C.Ex.: Comparative Example

In Table, ○, Δ and × have the same meanings as those in Table 22.

Examples K-1~K-11 and Comparative Example K-1

Polyethylene-2,6-naphthalate having 10 mol % of terephthalic acid and 1 mol % of sodium sulfoisophthalate copolymerized (intrinsic viscosity=0.55~0.59, naphthalenedicarboxylic acid=89 mol %) and nylon 6 (intrinsic viscosity=1.3) were used in a volume ratio (composite-forming ratio) of 2/3 and co-spun through a spinneret shown in FIG. 10, and an undrawn yarn whose alternate laminate portion as shown in FIG. 2 had 30 layers was taken up at a take-up rate of 1,500 m/minute. This as-spun yarn was drawn to 2.0 times with a roller-type drawing machine equipped with a feed roller heated at 110° C. and a drawing roller heated at 170° C., to give a drawn yarn of 90 denier/12 filaments. Layers of two polymers in the center of the flat yarn were measured for a thickness and it was found that the polyethylene-2,6-naphthalate copolymer layer had a thickness of 0.07 μm and that the nylon layer had a thickness of 0.08 μm. An interference color of green was recognized. Further, the monofilaments had a flattening ratio of 5.6. The thus-obtained fiber having an optical interference effect was combined with other fiber and formed into various textiles. Table 24 shows the results.

TABLE 24

| | Texture of textile | Warp (twisting number) | Weft (twisting number) |
|---|---|---|---|
| C. Ex. K-1 | 1/1, plain-woven textile | 90 denier (optical-interference yarn) (150) | 75 denier. 24 filaments, black-colored spun dye yarn (12) |
| Ex. K-1 | 2/2, twill-woven textile | 90 denier (optical-interference yarn) (150) | 75 denier. 24 filaments, black-colored spun dye yarn (12) |
| Ex. K-2 | 3/2 (1 displacement), twill-woven textile | 90 denier (optical-interference yarn) (150) | 75 denier. 24 filaments, black-colored spun dye yarn (12) |
| Ex. K-3 | 4/1 (2 displacements), satin textile | 90 denier (optical-interference yarn) (150) | 75 denier. 24 filaments, black-colored spun dye yarn (12) |
| Ex. K-4 | 4/1 (2 displacements), satin textile | 75 denier black-colored spun dye yarn (150) | 90 denier (optical interference yarn) (11) |
| Ex. K-5 | 8/2 (4 displacements), satin textile | 90 denier (optical interference yarn) (150) | 75 denier black-colored spun dye yarn (14) |
| Ex. K-6 | 8/2 (4 displacements), satin textile | 90 denier (optical interference yarn) (150) | 90 denier (optical interference yarn) (11) |
| Ex. K-7 | 8/2 (2 lines and 4 displacements), satin textile | 75 denier black-colored spun dye yarn (150) | 90 denier (optical interference yarn) (11) |
| Ex. K-8 | 8/2 (2 lines and 4 displacements), satin textile | 90 denier (optical interference yarn) (150) | 90 denier (optical interference yarn) (11) |
| Ex. K-9 | 8/2 (2 line and 4 displacements), satin textile | 90 denier (optical interference yarn) (250) | 75 denier black-colored spun dye yarn (15) |
| Ex. K-10 | 8/2 (2 lines and 4 displacements), satin textile | 90 denier (optical interference yarn) (500) | 75 denier black-colored spun dye yarn (15) |
| Ex. K-11 | 8/2 (2 lines and 4 displacements), satin textile | 90 denier (optical interference yarn) (150) | 75 denier black-colored spun dye yarn (15) |

| | Float number of optical interference fiber | Float ratio of optical interference fiber | Optical interference effect |
|---|---|---|---|
| C. Ex. K-1 | 1 | 50% | Different-color effect alone. Low degree of gloss. |
| Ex. K-1 | 2 | 50% | Gloss to some extent. Anisotropic effect slightly recognized. |
| Ex. K-2 | 3 | 60% | Gloss to some extent. Anisotropic effect recognized. |
| Ex. K-3 | 4 | 80% | Considerable gloss. Anisotropic effect considerably recognized. |
| Ex. K-4 | 4 | 80% | Clear gloss. Anisotropic effect intensely recognized. |
| Ex. K-5 | 8 | 80% | Intense gloss. Anisotropic effect intensely recognized. |
| Ex. K-6 | 4 | 80% | Intense gloss. Anisotropic effect intensely recognized. |
| Ex. K-7 | 8 | 80% | Clear gloss. Anisotropic effect remarkably intensely recognized. |
| Ex. K-8 | 8 | 80% | Intense gloss. Anisotropic effect intensely recognized. |
| Ex. K-9 | 8 | 80% | Clear gloss. Anisotropic effect intensely recognized. |

TABLE 24-continued

| | | | |
|---|---|---|---|
| Ex. K-10 | 8 | 80% | Gloss to some extent. Anisotropic effect slightly recognized. |
| Ex. K-11 | 8 | 80% | Slight gloss. Slight development of a color and anisotropic effect slightly recognized. |

Ex.: Example,
C. Ex.: Comparative Example

Examples K-12~K-14

A composite yarn was spun in the same manner as in Example K-1 except that the number of layers of the alternate laminate portion was changed to 15. The obtained undrawn yarn was drawn to 1.8 times with the same roller-type drawing machine as used in Example K-1, to give a drawn yarn of 78 denier/12 filaments. Layers of two polymers in the center of the major axis direction of the flat yarn were measured for a thickness and it was found that the polyethylene-2,6-naphthalate copolymer layer had a thickness of 0.09 $\mu$m and that the nylon layer had a thickness of 0.10 $\mu$m. An interference color of red was recognized. Further, the mono-filaments had a flattening ratio of 5.5. The thus-obtained fiber having an optical interference effect was combined with other fiber and formed into various textiles. Table 25 shows the results.

TABLE 25

| | Texture of textile | Warp (twisting number) | Weft (twisting number) |
|---|---|---|---|
| Ex. K-12 | 8/2 (2 lines and 4 displacements), satin textile | 75 denier, red-colored spun dye yarn (300) | 78 denier (optical interference yarn) (11) |
| Ex. K-13 | 8/2 (2 lines and 4 displacements), satin textile | 75 denier, green-colored spun dye yarn (300) | " |
| Ex. K-14 | 8/2 (2 lines and 4 displacements), satin textile | 75 denier, violet-colored spun dye yarn (300) | " |
| | Float number of optical interference fiber | Float ratio of optical interference fiber | Optical interference effect |
| Ex. K-12 | 8 | 80% | Slight gloss. Development of slight color. Anisotropic effect slightly recognized. |
| Ex. K-13 | 8 | 80% | Clear gloss. Remarkably clear anisotropic effect recognized. |
| Ex. K-14 | 8 | 80% | Intense gloss. Intense anisotropic effect recognized. |

Ex.: Example

Examples L-1~L-7 and Comparative Examples L-1~L-2

Polyethylene-2,6-naphthalate having 10 mol % of terephthalic acid and 1 mol % of sodium sulfoisophthalate copolymerized (intrinsic viscosity=0.59, naphthalenedicarboxylic acid=89 mol %) and nylon 6 (intrinsic viscosity=1.3) were used in a volume ratio (composite-forming ratio) of 1/5 and co-spun through a spinneret shown in FIGS. 7 to 10, and an undrawn yarn whose alternate laminate portion as shown in FIG. 2 had 30 layers was taken up at a take-up rate of 1,500 m/minute. This as-spun yarn was drawn to 2.0 times with a roller-type drawing machine equipped with a feed roller heated at 110° C. and a drawing roller heated at 170° C., to give a drawn yarn of 90 denier/12 filaments. Layers of two polymers in the center of the flat yarn were measured for a thickness and it was found that the polyethylene-2,6-naphthalate copolymer layer had a thickness of 0.07 $\mu$m and that the nylon layer had a thickness of 0.08 $\mu$m. An interference color of green was recognized. Further, the mono-filaments had a flattening ratio of 5.6. A plurality of the thus-obtained filaments having an optical interference effect were combined, and 10% of a sizing agent was applied thereto, to give a yarn of the substantially non-twisted optical interference filaments having improved bundle formability, and a substrate cloth was embroidered therewith: Table 26 shows the results.

TABLE 26

| | Stacking number of embroidery yarns on fabric | Color of ground fabric | Optical interference effect |
|---|---|---|---|
| C. Ex. L-1 | 112 | Black | Embroidery yarn developed no color. (transparent and white based on surface reflection) |

TABLE 26-continued

| | Stacking number of embroidery yarns on fabric | Color of ground fabric | Optical interference effect |
|---|---|---|---|
| C. Ex. L-2 | 85 | Black | Embroidery yarn developed no color. (transparent and white based on surface reflection) |
| Ex. L-1 | 75 | Black | Embroidery yarn slightly developed green. Slight gloss. |
| Ex. L-2 | 50 | Black | Embroidery yarn considerably developed color. Slight gloss. |
| Ex. L-3 | 9 | Black | Embroidery yarn developed intense color. Considerable gloss. |
| Ex. L-4 | 4 | Black | Embroidery yarn developed intense color. Graceful and intense gloss. |
| Ex. L-5 | 5 | Green | Embroidery yarn slightly developed color. Slight gloss. |

TABLE 26-continued

| | Stacking number of embroidery yarns on fabric | Color of ground fabric | Optical interference effect |
|---|---|---|---|
| Ex. L-6 | 4 | Red | Embroidery yarn developed remarkably intense color. Graceful intense and gloss. |
| Ex. L-7 | 4 | Blue | Embroidery yarn slightly developed color. Slight gloss. |

Ex.: Example,
C. Ex.: Comparative Example

What is claimed is:

1. A flat fiber having an optical-interference function, which is formed by alternately laminating individually independent layers of polymers having different refractive indices in parallel with the major axis direction of its flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$.

2. The fiber having the optical-interference function of claim 1, wherein (b) a protective layer of either of the polymers for forming an alternate laminate portion is formed on a circumferential portion of the flat cross section, the protective layer having a greater thickness than each of layers of the polymers, and half-width $\lambda_{L=1/2}$ of reflection spectrum of the filaments is in the range of $0\ nm < \lambda_{L=1/2} < 200\ nm$.

3. The fiber having the optical-interference function of claim 1, wherein the polymers (component A and component B) forming the individually independent layers of polymers are, respectively, polyethylene terephthalate (component A) and an aliphatic polyamide (component B).

4. The fiber having the optical-interference function of claim 1, wherein each of layers of the polymers in alternate laminate portion has a thickness of 0.02 to 0.3 $\mu$m and protective layer has a thickness of 2 $\mu$m to 10 $\mu$m.

5. The fiber having the optical-interference function of claim 1, wherein the fiber is formed by alternately laminating 5 to 120 individually independent layers of polymers having different refractive indices.

6. The fiber having the optical-interference function of claim 1, wherein the polymers (component A and component B) forming the individually independent layers of polymers are, respectively, polyethylene terephthalate (component A) having, as a comonomer component, 0.3 to 10 mol %, based on the total amount of all dibasic acid components constituting said polyester, of a dibasic acid component having a sulfonic acid metal salt and polymethyl methacrylate (component B) having an acid value of at least 3.

7. The fiber having the optical-interference function of claim 1, wherein the polymers (component A and component B) forming the individually independent layers of polymers are, respectively, polyethylene naphthalate (component A) having, as a comonomer component, 0.3 to 5 mol %, based on the total amount of all dibasic acid components constituting said polyester, of a dibasic acid component having a sulfonic acid metal salt and an aliphatic polyamide (component B).

8. The fiber having the optical-interference function of claim 1, wherein the polymers (component A and component B) forming the individually independent layers of polymers are aromatic copolyester (component A) comprising a dibasic acid component and/or glycol component, each having at least one alkyl group in a side chain, as comonomer component(s) in an amount of 5 to 30 mol %, based on the total amount of all recurring units, of the comonomer components and polymethyl methacrylate (component B).

9. The fiber having the optical-interference function of claim 1, wherein the polymers (component A and component B) forming the individually independent layers of polymers are, respectively, polycarbonate (component A) formed from 4,4'-hydroxydiphenyl-2,2-propane as a dihydric phenol component and polymethyl methacrylate (component B).

10. A fibrous structure having an improved function of optical-interference, characterized in that said fibrous structure contains flat optically interfering filaments which are formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, and a coating layer of a polymer is formed on at least the surface of said optically interfering filaments, a refractive index of said polymer being lower than the refractive index of a polymer which constitutes said optically interfering filaments and has a highest refractive index.

11. A multi-filament yarn characterized in that the multi-filament yarn (1) comprises, as a constituent unit, flat optically interfering filaments which are formed by alternately laminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, (2) the constituent filaments having a flattening ratio in the range of 4.0 to 15.0, and (3) the multi-filament yarn having an elongation at break in the range of 10 to 50%.

12. A multi-filament yarn having an optical-interference function of producing different colors, which comprises, as a constituent unit, flat optically interfering filaments which are formed by alternately laminating individually independent layers of polymers having different refractive indices in parallel with the major axis direction of the flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, said multi-filament yarn exhibiting the color development of different colors along the lengthwise direction thereof and/or among the filaments.

13. A multi-filament yarn having an improved function of optical interference, comprising, as a constituent unit, flat optically interfering filaments which are formed by alternately laminating individually independent layers of polymers having different refractive indices in parallel with the major axis direction of the flat cross section, characterized in that (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, the filaments being imparted with an axial twist in the lengthwise direction thereof.

14. A float textile having a function of optical interference, characterized in that said textile contains, as a warp and/or weft, a texture construction of at least two float components formed of a multi-filament yarn comprising, as a constituent unit, flat optically interfering filaments which are formed by alternately laminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$.

15. An embroidery fabric, characterized in that said fabric is prepared by embroidering a substrate cloth with a multi-filament yarn, as an embroidery yarn, comprising, as a constituent unit, flat optically interfering filaments which are formed by alternately laminating individually independent layers of polymers having different refractive indices in parallel with the major axis direction of the flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$, the stacking number of the filaments constituting the embroidery yarn stacked in the direction intersecting at right angles the substrate cloth being 2 to 80.

16. A composite yarn comprised of a high-shrinkable yarn and a low-shrinkable yarn, characterized in that the low-shrinkable yarn is comprised of flat optically interfering filaments which are formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$.

17. A differently brightening non-woven fabric, characterized in that said non-woven fabric is obtained by randomly and collectively stacking flat optically interfering filaments in a state where the filaments are axially twisted at intervals along the lengthwise direction thereof, the flat filaments being formed by alternately laminating individually independent layers of polymers having different refractive indices in parallel with the major axis direction of a flat cross section, wherein (a) the ratio (SP ratio) of the solubility parameter value ($SP_1$) of high refractive index polymer to the solubility parameter value ($SP_2$) of low refractive index polymer is in the range of $0.8 \leqq SP_1/SP_2 \leqq 1.1$.

* * * * *